US008621701B2

(12) United States Patent
Meharry

(10) Patent No.: US 8,621,701 B2
(45) Date of Patent: Jan. 7, 2014

(54) DENTAL BRUSH ASSEMBLY AND METHOD FOR MAKING THE SAME

(75) Inventor: Michael R. Meharry, Moreno Valley, CA (US)

(73) Assignee: University of Iowa Research Foundation, Iowa City, IA (US)

( * ) Notice: Subject to any disclaimer, the term of this patent is extended or adjusted under 35 U.S.C. 154(b) by 583 days.

(21) Appl. No.: 12/918,645

(22) PCT Filed: Feb. 20, 2009

(86) PCT No.: PCT/US2009/001078

§ 371 (c)(1),
(2), (4) Date: Nov. 22, 2010

(87) PCT Pub. No.: WO2009/105242

PCT Pub. Date: Aug. 27, 2009

(65) Prior Publication Data

US 2011/0061190 A1 Mar. 17, 2011

Related U.S. Application Data

(60) Provisional application No. 61/030,801, filed on Feb. 22, 2008.

(51) Int. Cl.
*A47L 13/00* (2006.01)

(52) U.S. Cl.
USPC ..... 15/106; 15/105; 15/167.1; 15/206

(58) Field of Classification Search
USPC ..... 15/105, 106, 167.1, 206
See application file for complete search history.

(56) References Cited

U.S. PATENT DOCUMENTS

| | | | | |
|---|---|---|---|---|
| 4,030,199 | A * | 6/1977 | Russell | 433/147 |
| 4,572,223 | A | 2/1986 | Rosenfeld | |
| 4,894,207 | A | 1/1990 | Archer et al. | |
| 4,923,899 | A | 5/1990 | Wachman et al. | |
| 6,247,477 | B1 * | 6/2001 | Wagner | 132/309 |
| 6,345,406 | B1 | 2/2002 | Dodd | |
| 6,511,319 | B1 | 1/2003 | Hunter | |

OTHER PUBLICATIONS

"International application serial No. PCT/US2009/01078 Search report mailed May 5, 2009", 4 pgs.
"International application serial No. PCT/US2009/01078 Written Opinion mailed May 5, 2009", 11 pgs.

* cited by examiner

*Primary Examiner* — Lee D Wilson
*Assistant Examiner* — Shantese McDonald
(74) *Attorney, Agent, or Firm* — Schwegman Lunderberg & Woessner, P.A.

(57) ABSTRACT

A dental brush assembly includes an elongate handle having first and second coupling ends sized and shaped to couple with at least a first detachable dental brush. The first coupling end is at a first angle relative to a handle longitudinal axis and the second coupling end is at a second different angle relative to the handle longitudinal axis. The first coupling end includes first and second brush facing surfaces. The second coupling end includes third and fourth brush facing surfaces. The first detachable dental brush includes a directional brush surface and a brush end complementary to the first, second, third and fourth brush facing surfaces. The directional brush surface is directed in first, second, third or fourth non-identical orientations relative to the handle longitudinal axis depending on which brush facing surface the first detachable dental brush is oriented with.

32 Claims, 18 Drawing Sheets

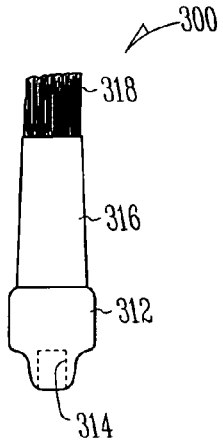
Fig. 3A
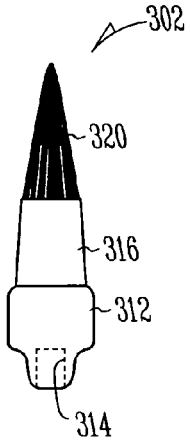
Fig. 3B
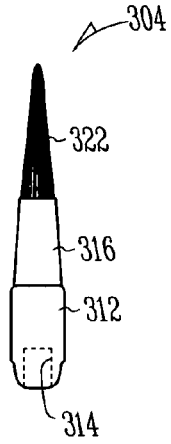
Fig. 3C
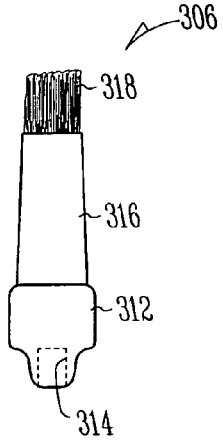
Fig. 3D
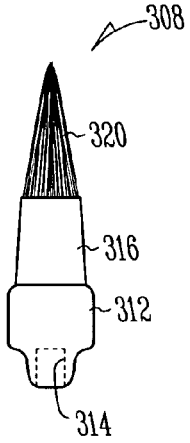
Fig. 3E
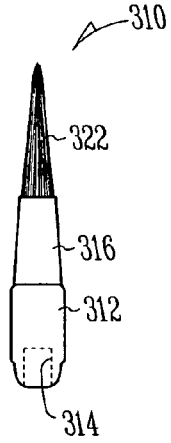
Fig. 3F
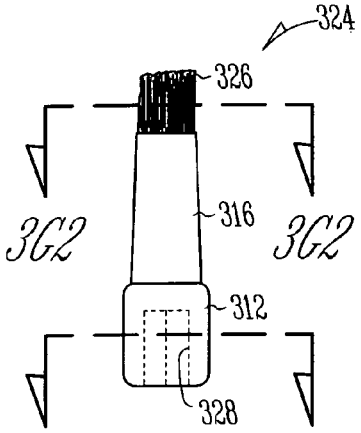
Fig. 3G
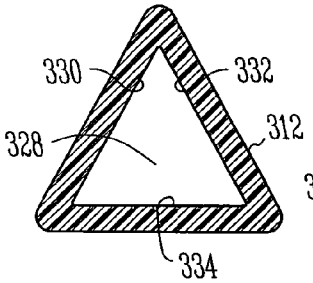
Fig. 3G1
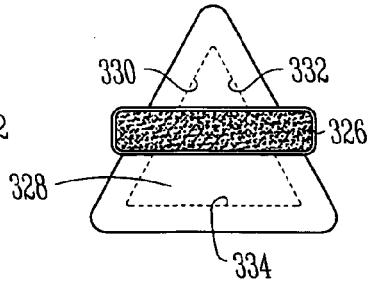
Fig. 3G2

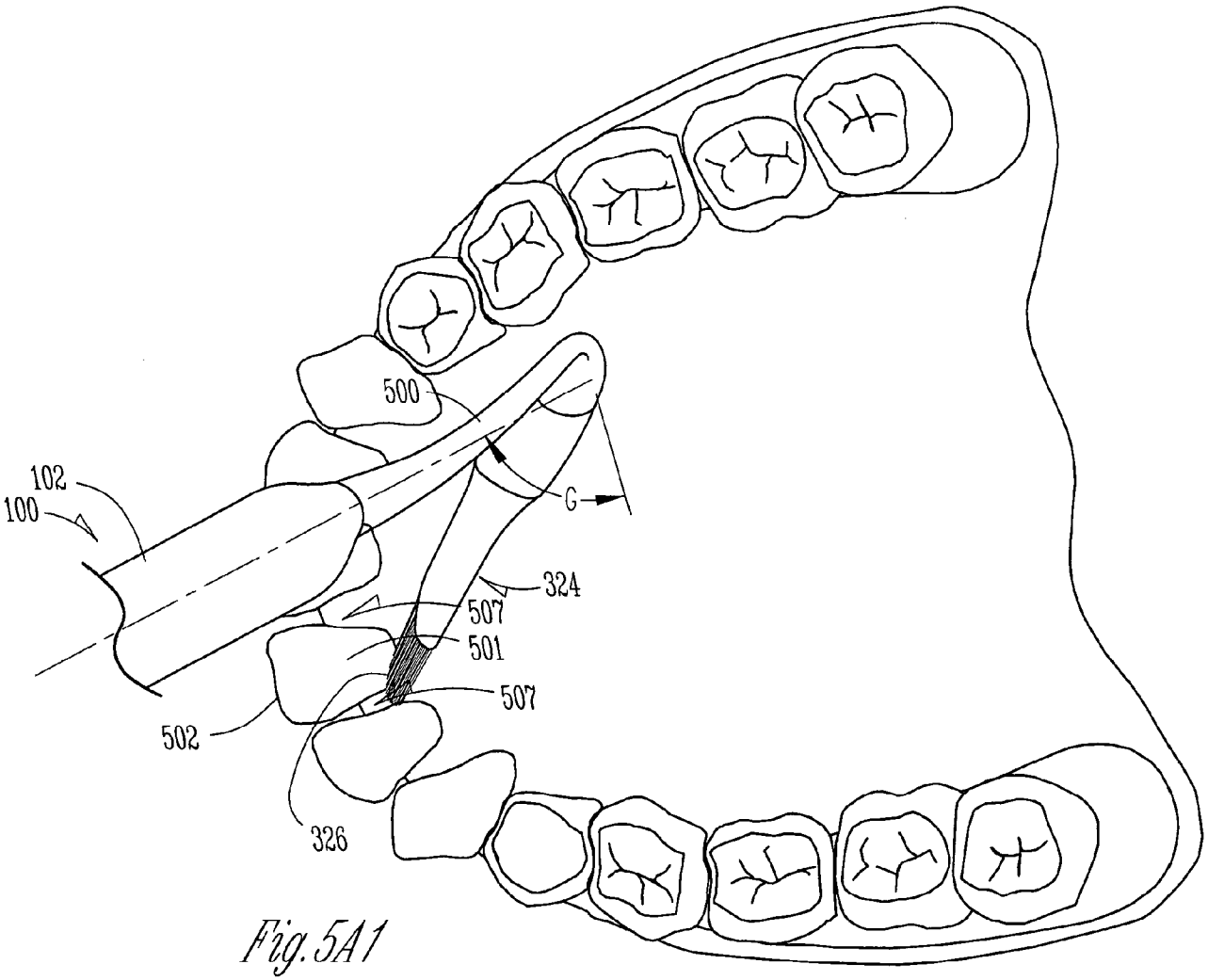
Fig. 5A1

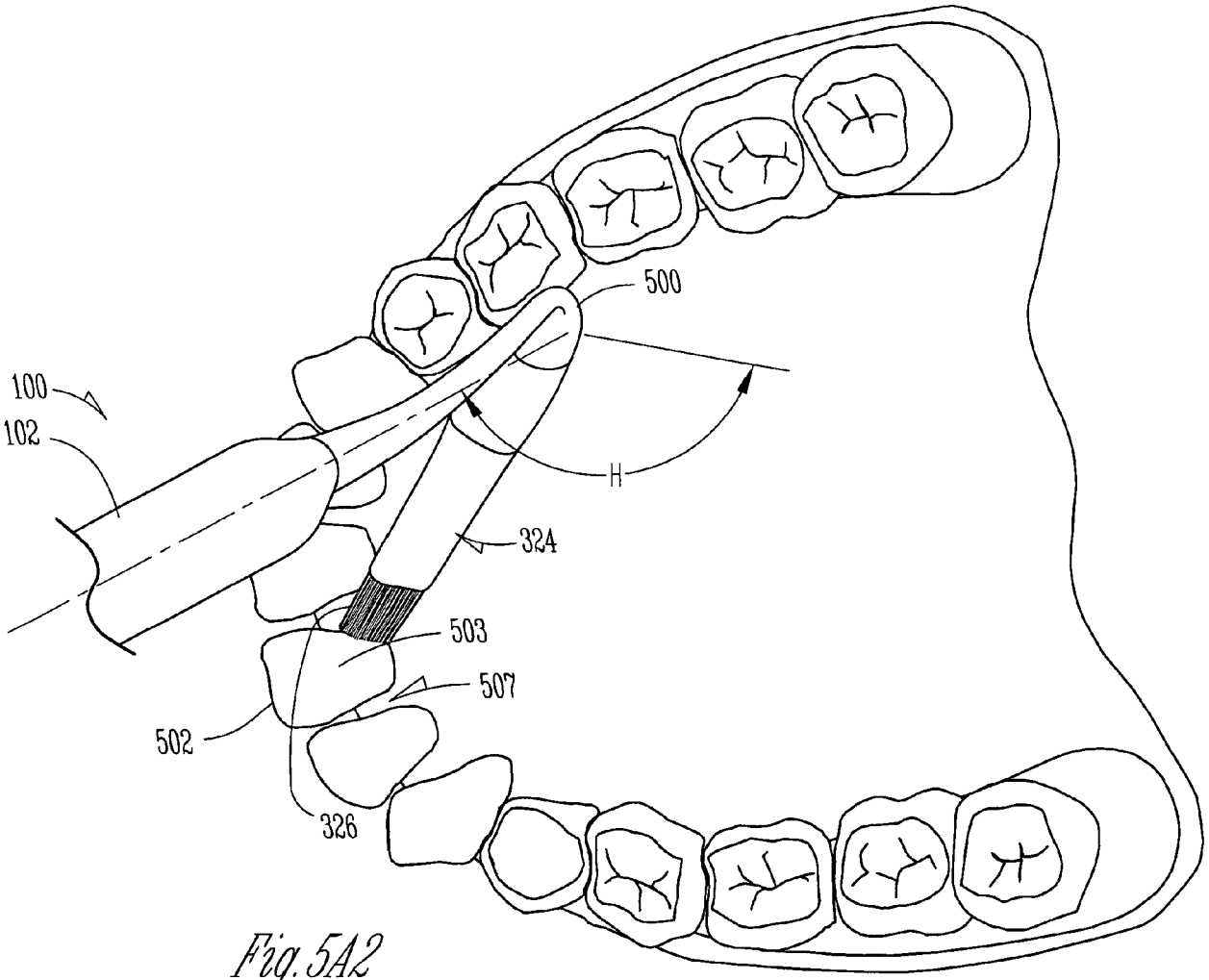
Fig. 5A2

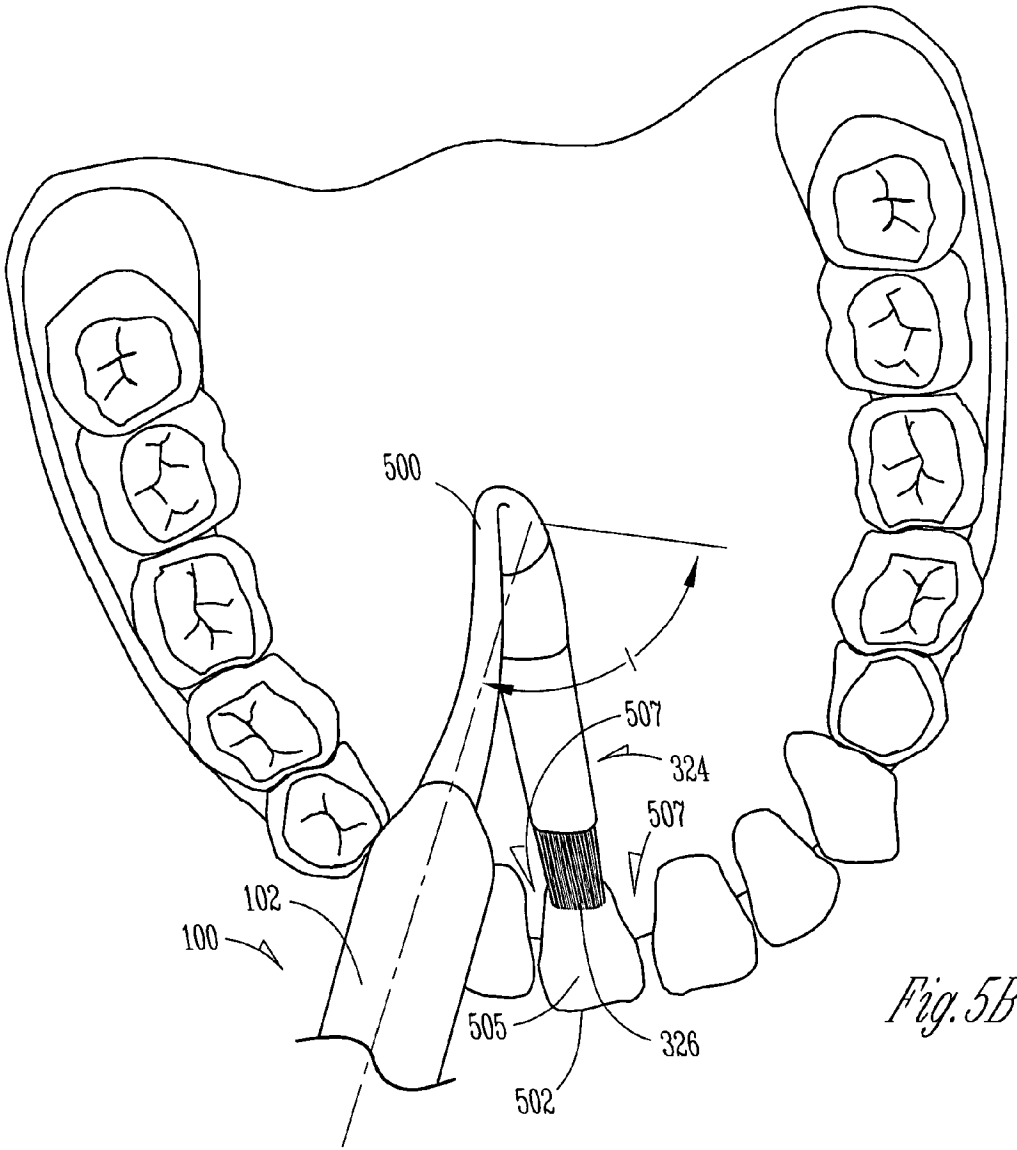
Fig. 5B1

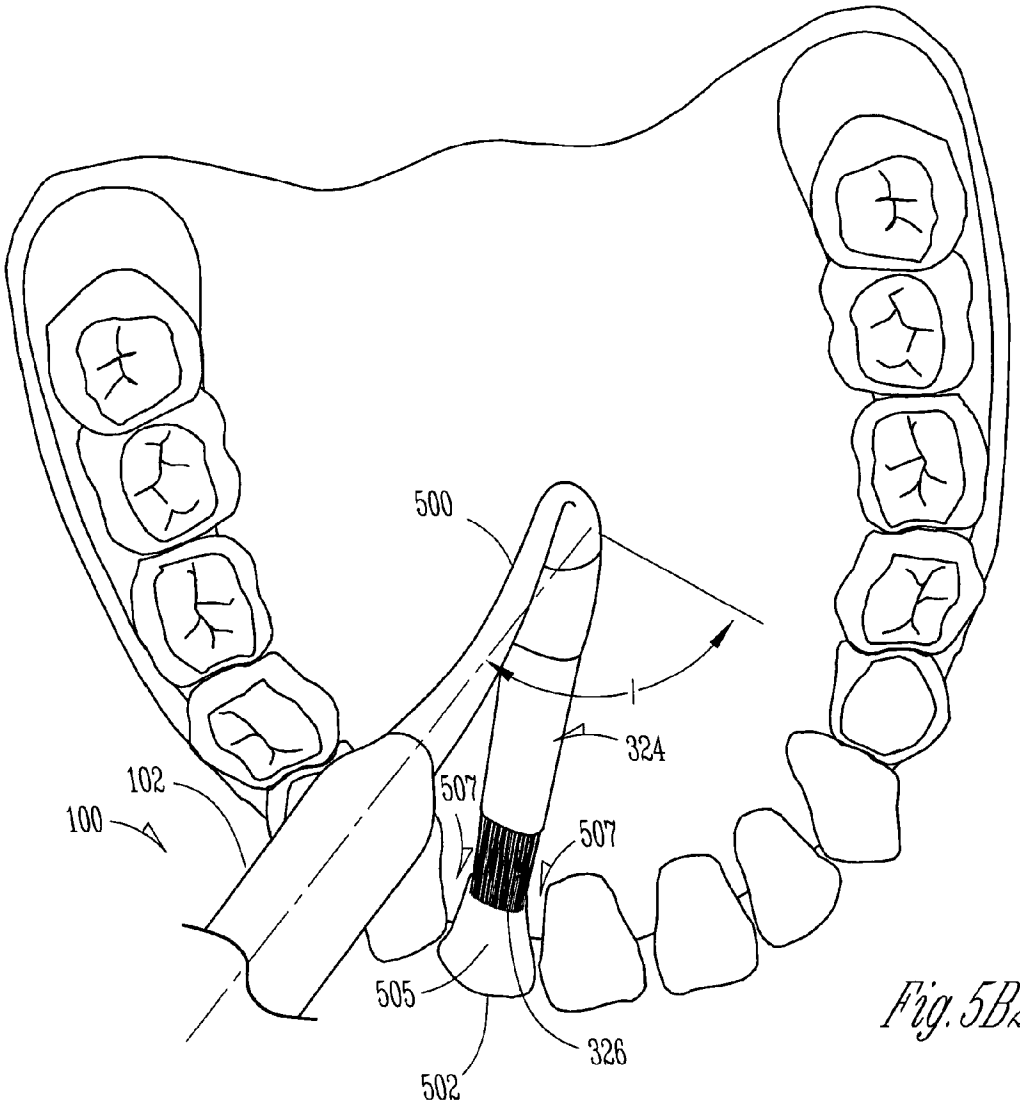
Fig. 5B2

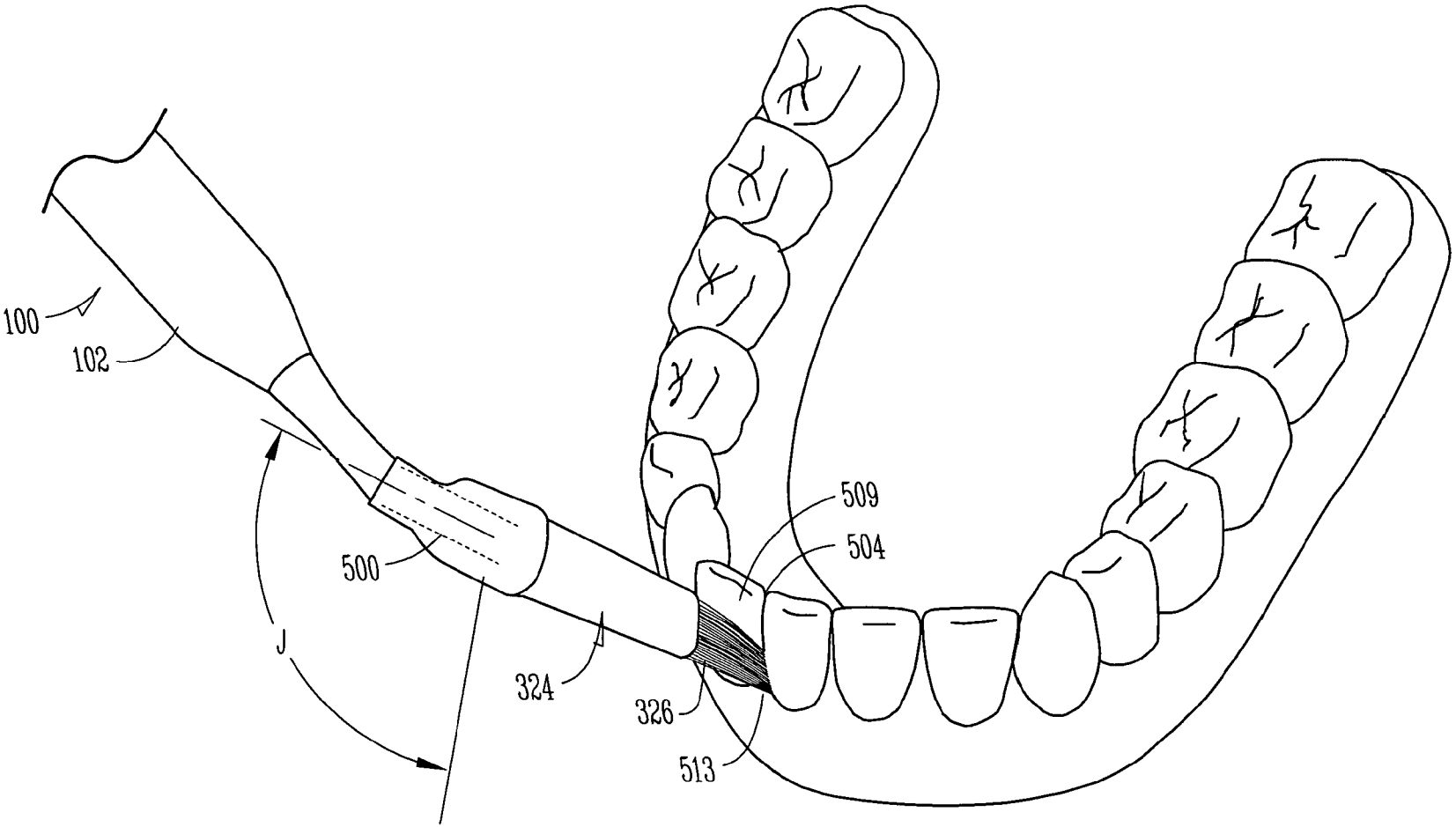
Fig. 5C1

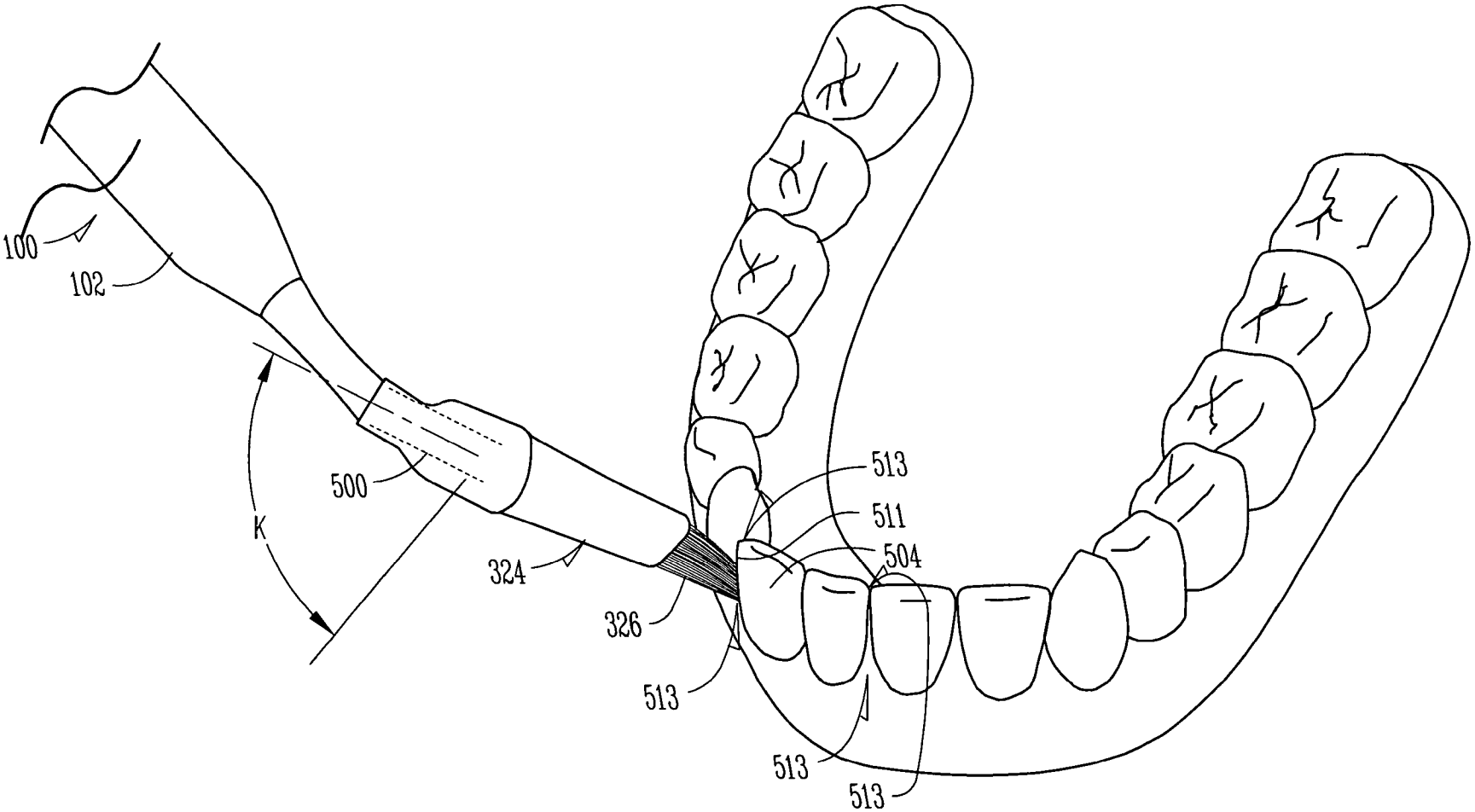
Fig. 5C2

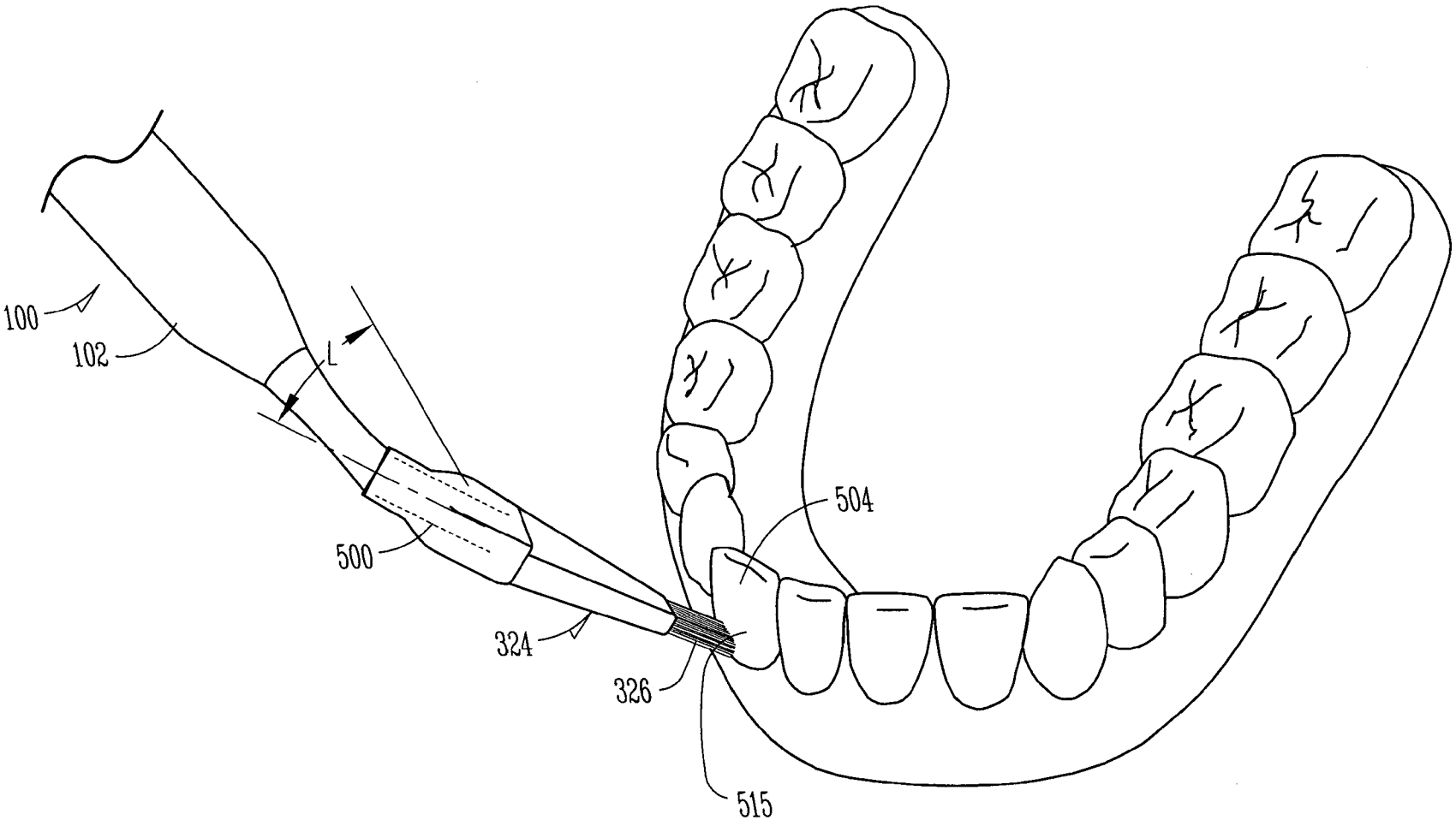
Fig. 5D1

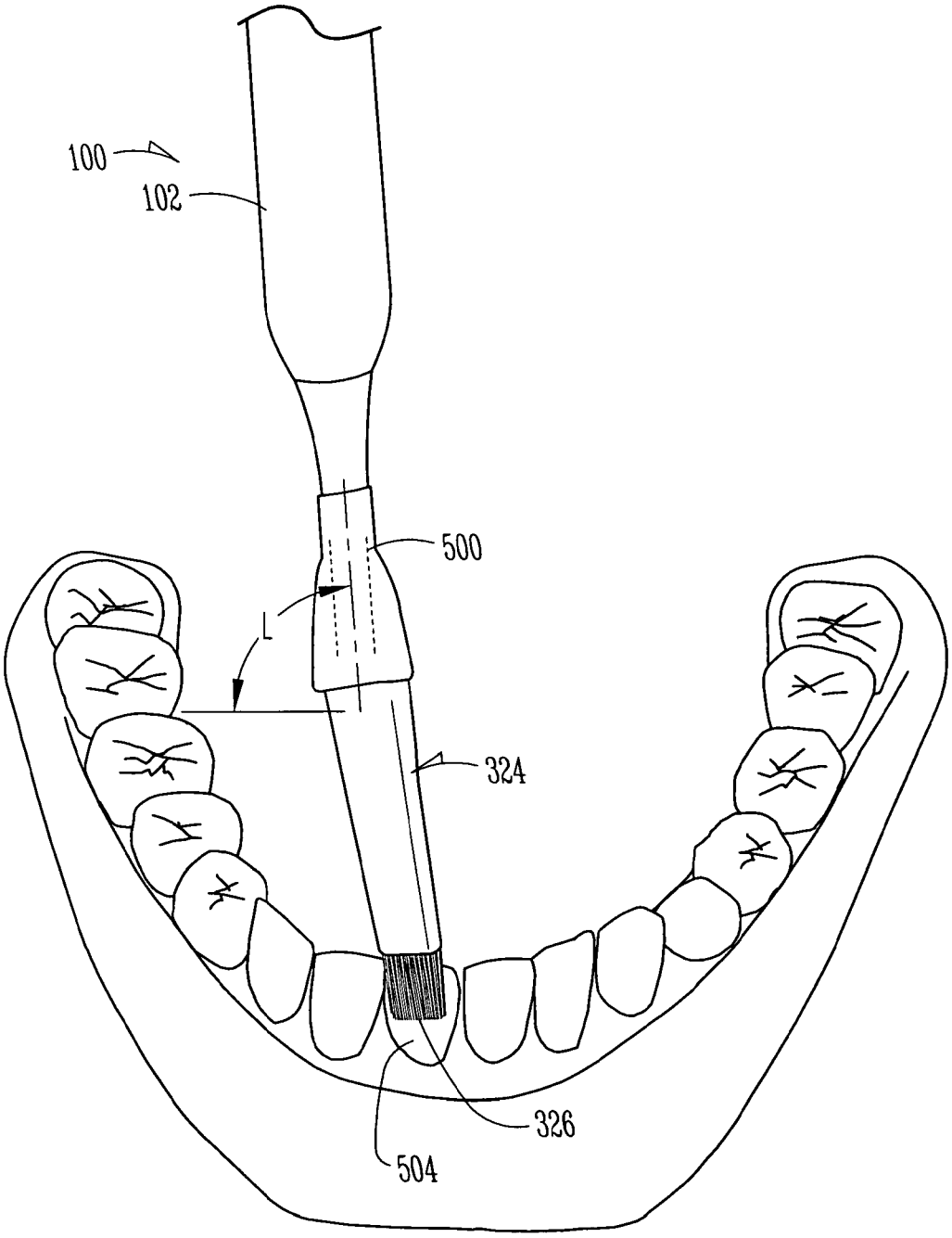
Fig. 5D2

DENTAL BRUSH ASSEMBLY AND METHOD FOR MAKING THE SAME

RELATED APPLICATION

This patent application is a U.S. National Stage Filing under 35 U.S.C. 371 from International Patent Application Ser. No. PCT/US2009/001078, filed Feb. 20, 2009, and published on Aug. 27, 2009, as WO 2009/105242 A1, which claims the benefit of priority from U.S. Provisional Patent Application Ser. No. 61/030,801 filed Feb. 22, 2008, the contents of which are incorporated herein by reference in their entirety.

TECHNICAL FIELD

Dental brushes, and particularly dental brushes used to apply and sculpture dental composite and porcelain work.

BACKGROUND

Many current brushes used to apply and sculpture composite resin materials (e.g., smooth the composite resin over a tooth surface and across a filling) in dentistry are straight artist brushes designed for applying paint to easily accessible painting surfaces, such as canvas. The oral cavity presents a number of surfaces that are difficult to reach for oral hygiene (e.g., tooth brushing, flossing and the like). These areas include the lingual areas of the teeth (the tongue side of teeth), the gingival marginal areas (where a tooth meets with the gum), embrasure spaces (spaces between teeth) and occlusal surfaces of the posterior teeth (chewing surfaces of the molars). These areas see a larger percentage of dental issues including decay and cavities requiring dental restoration work such as composite fillings, sealants and the like. As previously described with oral hygiene, these difficult to reach areas are similarly difficult to reach with current straight brushes used to apply and sculpture composite material for dental restoration. A variety of brushes are used with differing shaped brush surfaces and then the user contorts the hand and wrist to reach the desired surfaces of the teeth.

A dental tool with an angled head fails to address these problems as a single angle cannot adequately access every tooth surface that may need attention in the mouth. Similarly, a single brush type cannot easily apply and sculpt composite material over a variety of tooth surfaces and filling locations.

BRIEF DESCRIPTION OF THE DRAWINGS

FIGS. 3A-3G2 are side views of examples of detachable brushes with varying brush configurations usable with the dental brush assembly.

FIGS. 5A1-5D2 are views of exemplary anterior dental surfaces and elongate handle and brush orientations usable for dental work along the dental surfaces.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
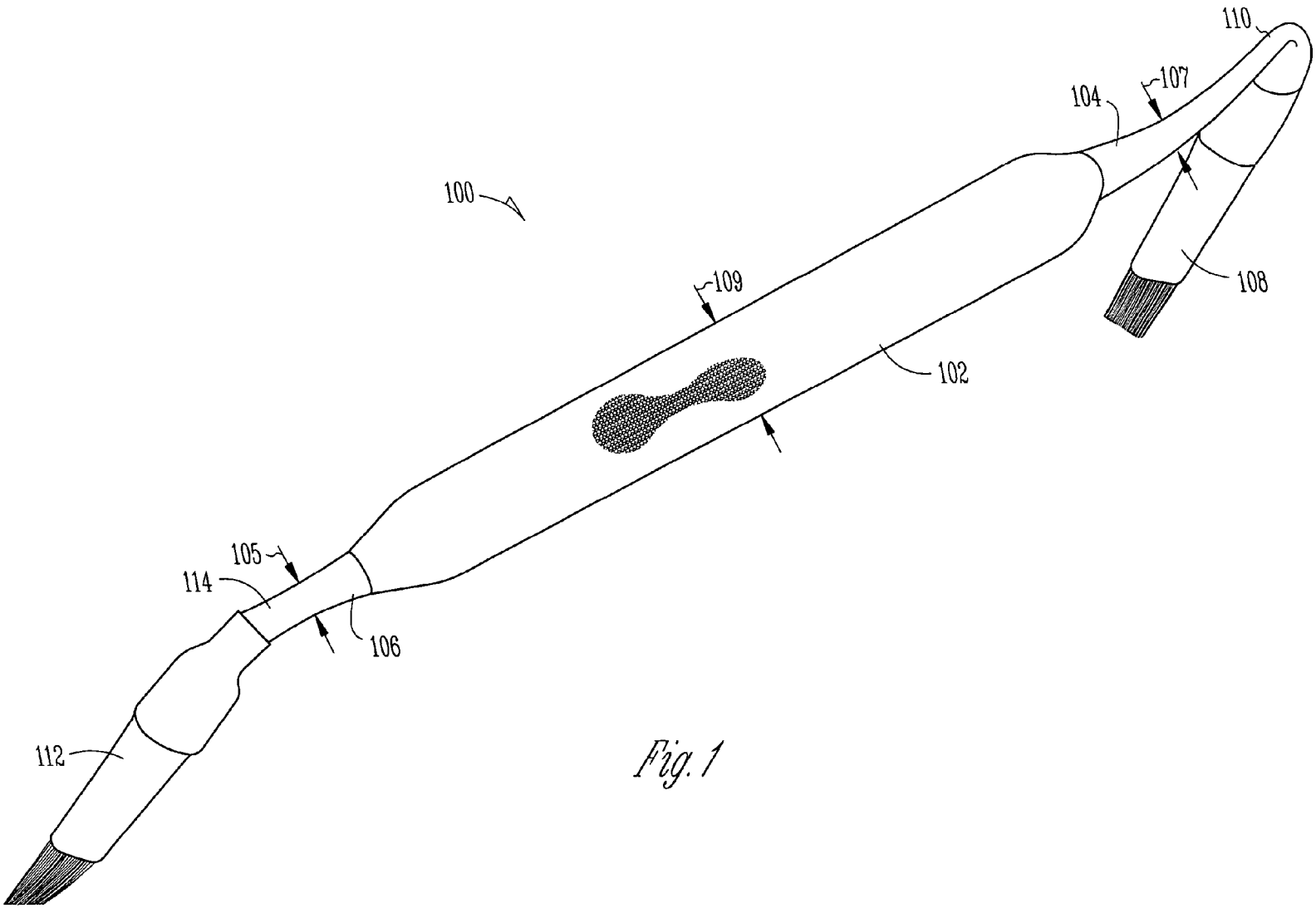
FIG. 1 is a perspective view of one example of a dental brush assembly

A dental brush assembly 100 for forming composite dental materials is shown in FIG. 1. The assembly 100 includes a handle 102, a first shank 104 and a second shank 106. A first detachable dental brush 108 is detachably coupled with the first shank 104 at a first coupling 110, and a second detachable dental brush 112 is detachably coupled with the second shank 106 at a second coupling 114 (the first shank and first coupling provide a first coupling end of the handle, in one example, and the second shank and second coupling similarly provide a second coupling end). The dental brush assembly 100 is used to finish composite materials, for instance, by forming tooth line angles, cusps, ridges and the like. In another example, the dental brush assembly 100 is used to finish composite materials by planarizing the composite into a flush configuration with the surrounding tooth enamel.

The handle 102 is sized and shaped to provide an ergonomic grip for the user to easily grasp the dental brush assembly 100 and use either or both of the brushes 108, 112 for forming composite materials for dental work (e.g., composite fillings, crown construction and the like). The handle 102 has a larger diameter 109 to provide a comfortable grip for the user and facilitate fine motor control of the dental brush assembly 100. Additionally, the first and second shanks 104, 106 have smaller diameters 105, 107 relative to the handle diameter 109 as they approach the brushes 108, 112 for ease of use within the mouth of a patient. The handle 102 is constructed with, but not limited to metals, composites and the like, such as aluminum, stainless steel and plastics.

As shown in FIG. 1, the first shank 104 and the second shank 106 are at different orientations relative to the handle 102. In one example, these orientations are non-identical, and the first and second shanks 104, 106 similarly position the dental brushes 108, 112 to provide multiple non-identical orientations to access and form composite materials in the mouth (e.g., for finishing of composite fillings). The user may thereby have multiple brush orientations available to easily form composite materials while keeping his hand in a small number of relatively comfortable postures. Similarly, the dental brush assembly 100 provides multiple angles of attack for dental surfaces in a single assembly. Providing multiple brush orientations alleviates hand strain and enhances the forming of composite dental material into the desired surface. Additionally, the non-linear orientations of the brush relative to the handle improve visibility of the operative field (e.g., the dental surface) for the user where a straight brush and handle combination may partially conceal the dental surface.

Figure 2A:
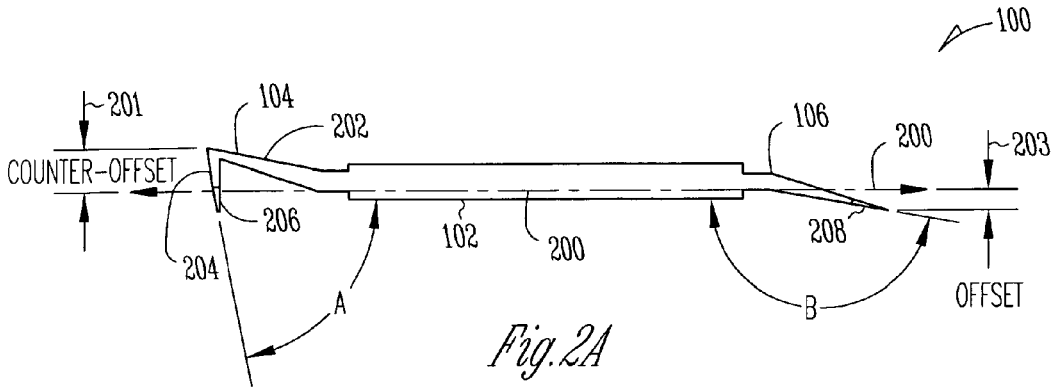
FIGS. 2A-2C are side views of examples of elongate handles with varying coupling end configurations usable with the dental brush assembly.

Referring now to FIG. 2A, one example of a dental brush assembly 100 is shown with first and second shanks 104, 106 having non-identical and unique orientations relative to the handle longitudinal axis 200. The variations in the shank orientations allow for multiple brush orientations that facilitate easy forming of composite materials within the mouth along dental surfaces as well as in composite construction, such as crown construction. As shown, the first shank 104 has a counter-offset orientation 201 and a first portion 202 of the first shank 104 extends away from the handle longitudinal axis 200 while a second portion 204 of the first shank 104 positions the detachable dental brush 206 near the handle longitudinal axis 200. This counter-offset orientation allows the detachable dental brush 206 to have a near-perpendicular orientation relative to the handle 102 without the dental brush 206 extending remotely away from the handle longitudinal axis 200 (e.g., the axis 200 extends through the brush 206). The counter-offset orientation thereby maintains a compact brush configuration along the handle for difficult-to-reach and relatively small areas of the mouth, for instance the space between the molar occlusal surfaces (chewing surfaces), and lingual surfaces of the anterior teeth (tongue side surfaces of the front teeth). Additionally, as shown in FIG. 2A, the first shank 104 has an angular orientation A relative to the handle longitudinal axis 200 of approximately 80 degrees. This allows the dental brush 206 to reach behind the anterior teeth and easily contact composite material applied to the lingual tooth surfaces while handle 102 is held at a relatively comfortable orientation (e.g., parallel with the plane of the upper jaw). The dental brush 206 is thereby provided with an angle of attack that easily extends from behind the teeth toward the lingual surfaces while the handle 102 extends out of the mouth.

The second shank 106 has an offset orientation 203 and the second shank extends away from the handle longitudinal axis 200. The detachable dental brush 208 is thereby similarly positioned away (remote relative to the counter-offset brush) from the handle longitudinal axis 200. This offset configuration facilitates longer brushing strokes usable with easily reached dental surfaces, for instance the facial surfaces of the anterior teeth (the front surfaces of the front teeth), as shown and described further below. Further, as shown in FIG. 2A, the second shank 106 has an angular orientation B relative to the handle longitudinal axis 200 of approximately 165 degrees. In another example, the first and second shanks 104, 106 have angular orientations A, B of between around 80 degrees and 165 degrees relative to the handle longitudinal axis 200. In still another example, and shown in FIGS. 2A-C, the first and second shanks 104, 106 have non-identical angular orientations. The non-identical angular orientations A, B cooperate with the offsets 201, 203 to provide a variety of orientations for the detachable dental brushes 206, 208. This variety of brush orientations gives the user multiple options for accessing a desired dental surface while allowing the hand of the user to comfortably manipulate the dental brush assembly handle 102 in fewer orientations.

Figure 2B:
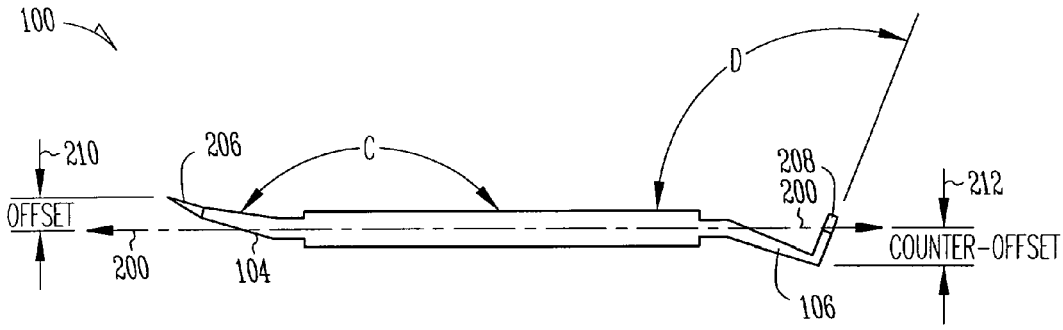

FIG. 2B shows another example of a dental brush assembly 100. The first shank 104 is shown with an offset configuration 210, and the second shank has a counter-offset configuration 212. The angular orientation C of the first shank 104 is approximately 165 degrees while the angular orientation D of the second shank 106 is approximately 100 degrees relative to the handle longitudinal axis 200. The counter-offset configuration 212 and angular orientation D of the second shank 106 facilitate access to compact areas of the mouth such as the anterior facing ridges and cusps of the molars (e.g., the ridged portions of the molar chewing surfaces that face toward the lips) and the molar mesial surfaces that form the embrasures between molars (e.g, the triangular geometry between teeth). The combination of orientations (e.g., angles of attack at dental surfaces) provided by the angular orientations C, D and the offset and counter-offset configurations 210, 212 gives the user multiple options for accessing a desired dental surface while allowing the hand of the user to comfortably manipulate the dental brush assembly handle 102 in fewer orientations.

Figure 2C:
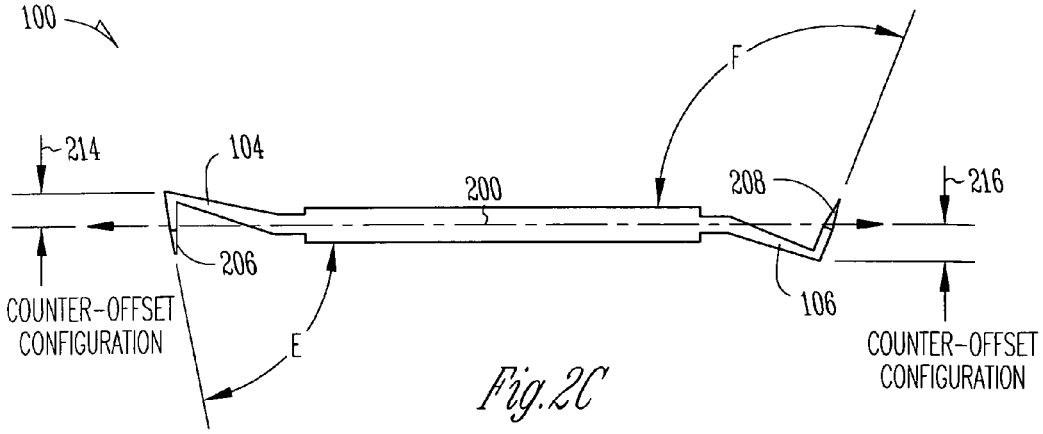

FIG. 2C shows yet another example of a dental brush assembly 100. Both shanks 104, 106 of this example assembly 100 have counter-offset configurations 214, 216. As previously described, the counter-offset configurations 214, 216 provide easier access to compact areas of the mouth while the detachable dental brushes 206, 208 are still at a near-perpendicular orientation relative to the handle longitudinal axis 200. In the compact area around the molars, for instance, because the detachable brushes 206, 208 are near the handle longitudinal axis 200, the brushes can easily form and finish composite material on the molars even at a near-perpendicular orientation to the handle longitudinal axis 200. Further, the counter-offset configurations 214, 216 allow for easy access to the lingual (tongue side) surfaces of all of the teeth including the molars and anterior teeth (front teeth).

Moreover, the angular orientations E, F of the shanks 104, 106, are usable for access to differing surfaces of the teeth. The angular orientation E, for instance, is approximately 80 degrees relative to the handle longitudinal axis 200. The angular orientation F, in another example, is approximately 100 degrees relative to the handle longitudinal axis 200. As previously described for angular orientation A in FIG. 2A, having an acute angular orientation (less than 90 degrees) such as E allows the detachable dental brush 206 to reach behind the anterior teeth and easily contact composite material applied to the lingual tooth surfaces while handle 102 is held at a relatively comfortable orientation (e.g., parallel with the plane of the upper jaw). Further, the acute angular orientations A, E provide easy access to the marginal ridges and distal line angles of the distal areas of the molars that form the distal embrasures of the molars on the lingual and facial sides of the teeth. The detachable dental brush 206 is thereby able to reach behind the molars to access these areas by using the angular orientations A, E of shank 104. Further still, the angular orientations A, E of the first shank 104 facilitate access to compact areas of the mouth such as the distal facing ridges and cusps of the molars (e.g., the ridged portions of the molar chewing surfaces that face toward the back of the mouth).

The angular orientation F of the second shank 106, as similarly described with regard to angular orientation D shown in FIG. 2B, facilitates access to compact areas of the mouth such as the mesial facing ridges and cusps of the molars (e.g., the ridged portions of the molar chewing surfaces that face toward the lips) and the mesial molar line angles and marginal ridges that form the embrasures between molars (e.g, the triangular geometry between teeth). The angular orientations D, F and counter-offsets 214, 216 provide a variety of brush orientations. These various brush orientations give the user multiple options for accessing a desired dental surface while allowing the hand of the user to comfortably manipulate the dental brush assembly handle 102 in fewer orientations.

Referring now to FIGS. 3A-3F, examples of detachable dental brushes are shown for detachable coupling and use with the handle 102 of the dental brush assembly 100 (FIG. 1). As shown, each brush, 300, 302, 304, 306, 308 and 310 includes a brush surface (described below) and brush end 312. The brush ends 312 include coupling orifices 314 sized and shaped to mate with the first and second couplings 110, 114 of the first and second shanks 104, 106, respectively (described further below and shown in FIG. 1). The brush surface is coupled with the brush end 312 by a neck 316. The neck 316 retains the brush bristles in the desired orientation, for instance, by crimping of the neck 316 over the brush bristles. In another example, the neck 316 is formed with a resin material, such as plastic, and the bristles are placed within the molten plastic and retained therein as the neck 316 hardens.

Brushes 300, 306 are shown in FIGS. 3A, D. The brushes 300, 306 include flat brush surfaces 318. The flat brush surfaces 318 provide a wide surface to smooth composite dental materials into a desired shape, for instance a composite surface flush with the surrounding surfaces of a tooth. Additionally, the flat brush surface 318 is usable along the mesial and distal surfaces of the teeth (the surfaces that extend toward the line angles dividing the facial and lingual portions of the teeth) and thereby define the embrasures between teeth as desired by the user. The brush 300 is constructed with stiff bristles, including, but not limited to horse, pig and synthetic bristles that are used to form and smooth viscous composites that are otherwise difficult to move with softer brushes. The brush 306 is constructed with soft bristles, including, but not limited to, sable, camel, and synthetic bristles that are used to form and smooth less viscous composites.

Brushes 302, 308 are shown in FIGS. 3B, E. The brushes 302, 308 include medium pointed brush surfaces 320. The medium pointed brushes 302, 308 provide a pointed surface to provide access to smaller dental areas where detailed brush work is needed, such as the gingival marginal areas (where the tooth meets the gum) and the embrasure spaces (e.g, the triangular geometry between teeth).

The brushes 304, 310 (FIGS. 3C, F) with fine pointed brush surfaces 322 provide even more detailed access to these areas and are used as needed where the medium pointed brushes 302, 308 cannot provide adequate access, for instance, where the medium pointed brushes could not fit into the apex of an embrasure.

As described above with regard to brush 300, the brushes 302, 304 are constructed with stiff bristles, including, but not limited to horse, pig and synthetic bristles that are used to form and smooth viscous composites that are otherwise difficult to move with softer brushes. The brushes 308, 310, similarly to brush 306, are constructed with soft bristles, including, but not limited to, sable, camel, and synthetic bristles that are used to form and smooth less viscous composites.

FIGS. 3G, 3G1, 3G2 show another example of a brush, a multi-orientation brush 324. The multi-orientation brush 324 includes a brush surface 326 (e.g., as shown a flat brush surface), a neck 316 and a brush end 312. The brush end 312 includes a non-circular coupling orifice 328 used in cooperation with a similarly formed coupling on the handle 102 (described below) to orient the brush surface 326 in a variety of orientations for added flexibility and enhanced access to dental surfaces while allowing the user to maintain the dental brush assembly handle 102 in a relatively comfortable posture.

Figure 4:
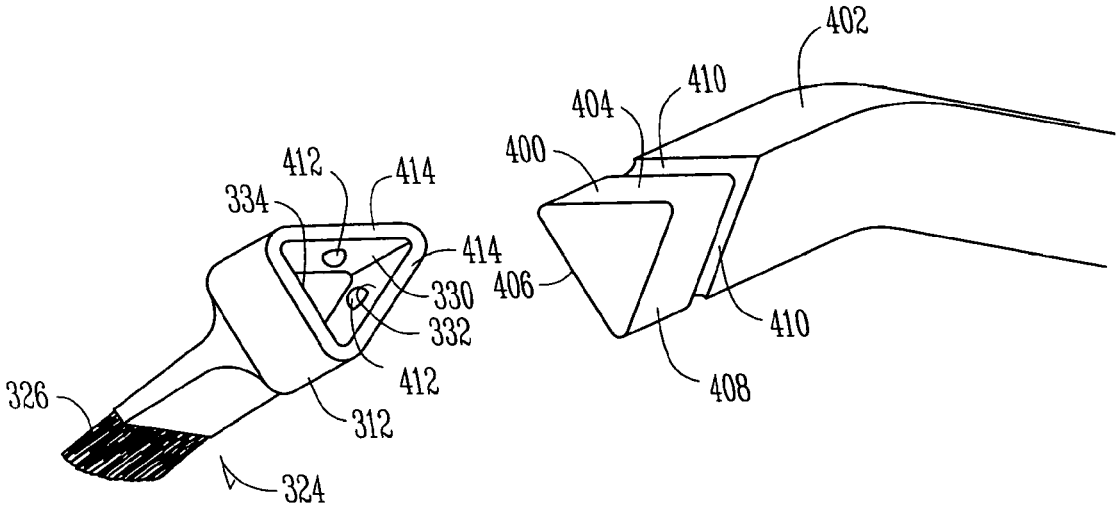
FIG. 4 are perspective views of one example of a multi-orientation brush and handle coupling for detachably coupling with the brush.

As shown in the cross-sectional view of FIG. 3G1, the non-circular coupling orifice 328 has a faceted geometry, in one example. The coupling orifice 328 shown in 3G1 has first, second and third facets 330, 332, 334. In another example, the coupling orifice includes two or more facets. Each of the first, second and third facets 330, 332, 334 corresponds to similar brush facing surfaces on the couplings 110, 114 of the handle 102 (FIG. 1, and FIG. 4, described below). As the facets 330, 332, 334 are aligned with the brush facing surfaces of the couplings 110, 114 the brush surface 326 is correspondingly oriented relative to the handle 102. See FIG. 3G2, where the brush surface 326 is shown relative to the facets 330, 332, 334. The first, second and third facets 330, 332, 334 allow the multi-orientation brush 324 to assume three separate orientations on each coupling 110, 114 of the handle 102 (FIG. 1). Because each of the shanks 104, 106 provides a different orientation, the multi-orientation brush 324 thereby may assume six separate orientations (three for each differently oriented shank). This provides the user a large variety of orientation options for the brush and gives enhanced access to difficult-to-reach dental surfaces while allowing the user to maintain the dental brush assembly 100 in a comfortable posture.

Optionally, the non-circular coupling orifice 328 has a different geometry, such as ovoid, star, square, multiple orifice geometries and the like. The non-circular geometry of the coupling orifice 328 cooperates with the similar geometry of the coupling 110, 114 to prevent rotation of the multi-orientation brush 324 relative to the handle 102 while also allowing detachment of the brush 324 and reattachment in a different orientation. In a similar manner, the previously described brushes 300, 302, 304, 306, 308, 310 also include coupling orifices 314 have non-circular geometries to prevent relative rotation between the handle 102 and the brushes.

FIG. 4 shows one example of the multi-orientation brush 324 separated from the coupling 400 and shank 402 (e.g., coupling 110 or 114, and shanks 104 or 106). As shown, the brush end 312 is provided with three facets 330, 332, 334, and the coupling end is provided with complementary first, second and third brush facing surfaces 404, 406, 408. When the multi-orientation brush 324 is detachably coupled with the coupling 400, the brush surface 326 is correspondingly oriented in one of a plurality of orientations. For example, when the multi-orientation brush 324 is detachably coupled with the coupling 400 and oriented with the first brush facing surface 404, the brush surface 326 is directed in a first orientation (e.g., parallel to the first brush facing surface). When the multi-orientation brush 324 is detachably coupled with the coupling 400 and oriented with the second brush facing surface 406, the brush surface 326 is directed in a second orientation approximately 45 to 60 degrees offset from the first orientation (e.g., parallel to the second brush facing surface). Similarly, when the multi-orientation brush 324 is detachably coupled with the coupling 400 and oriented with the third brush facing surface 408, the brush surface 326 is directed in a third orientation approximately 120 to 135 degrees offset from the first orientation (e.g., parallel to the third brush facing surface). Because the shanks 104, 106 each have a unique geometry relative to the other (e.g., offset and angular orientation) each of the three orientations of the brush surface 325 are different on each shank 104, 106 providing at least six possible orientations.

In another example, a coupling orifice with a different geometry (such as shape, number of facets and the like) and a correspondingly shaped coupling would provide a varied number of orientations for the brush surface 326. In such an example, where the coupling orifice and the coupling provide two possible orientations for the multi-orientation brush 324, with shanks 104, 106 having unique geometries, the brush surface 326 would have four possible orientations. Similarly, if the coupling orifice and the coupling have four or more orientations, then shanks 104, 106, each unique relative to the other shank, would provide a total of eight possible brush surface 326 orientations.

Referring again to FIG. 4, the coupling 400 is shown with a groove 410 extending at least part way around the coupling 400. The multi-orientation brush 324 is shown with one or more detents 412 sized and shaped to engage with the surfaces of the coupling 400 defining the groove 410 to removably lock the brush 324 on the coupling 400. As shown, the detents 412 are biased into an inward position by elastic members 414, such as springs. The groove 410 and detent 412 reliably hold the brush 324 in position on the coupling 400. In another example, the groove 410 and detent 412 provide an audible 'click' when engaged to assure the user the brush 324 has been successfully coupled with the coupling 400. Other means for removably locking the brush 324 with the coupling include, but are not limited to, magnetic features, temporary adhesives, snap-fit features, friction engagement and the like. In still another example, where the coupling orifice 314 is a circular orifice, the features, such as the detent 412 is engaged within a correspondingly shaped cavity to prevent rotation of the brush relative to the handle 102 (FIG. 1). Moreover, while the coupling orifices and couplings so far have been described as being present on the brushes and shanks respectively, the shanks include orifices and the brushes include couplings in another option.

FIGS. 5A1, 5A2 show the dental brush assembly 100 with the multi-orientation brush 324 in two separate orientations. The shank 500 has a counter-offset configuration, and in FIG. 5A1, the multi-orientation brush 324 is shown in a first orientation with the brush surface 326 at angle G of approximately 60 degrees relative to the elongate handle 102. In FIG. 5A2, the brush 324 is in a second orientation with the brush surface 326 at angle H of approximately 120 degrees relative to the elongate handle 102. The angle G of the brush surface 326 in FIG. 5A1 allows the brush surface to easily access the lingual distal surfaces 501 of the anterior tooth 502. The angle H of the brush surface 326 in FIG. 5A2 allows the brush surface to easily access the lingual mesial surfaces 503 of the anterior tooth 502. Both orientations of the brush surface 326 allow the user to easily access both areas of the tooth 502 with a single tool with the handle 102 in substantially the same comfortable orientation. Additionally, the counter-offset configuration allows the brush 324 to easily reach behind the anterior tooth 502 while the handle 102 extends outside of the mouth in a comfortable orientation for the user. Forming and finishing the lingual distal and lingual mesial surfaces of the anterior teeth are thereby easily performed to allow the user to form embrasures 507 between the teeth as desired.

FIGS. 5B1 and 5B2 show the dental brush assembly 100 with the multi-orientation brush 324 in another orientation. As described in FIGS. 5A1 and 5A2, the shank 500 has a counter-offset configuration. In FIGS. 5B1, 5B2 the brush 324 is shown in a third orientation with the brush surface 326 at angle I of approximately 90 degrees relative to the elongate handle 102. The angle I of the brush surface 326 in FIGS. 5B1, 5B2 allows the brush surface to easily access the lingual surfaces 505 of the anterior tooth 502 (e.g., the surfaces between the distal and mesial areas of the tooth). The three orientations shown in FIGS. 5A1-5B2 provide full access to the entire lingual surface of the teeth while allowing the handle 102 of the dental brush assembly 100 to comfortably extend out of the mouth into the user's hand in a comfortable orientation. The user is thereby able to comfortably and easily form and finish composite resin material in the difficult to reach area of the lingual surfaces of the teeth.

FIGS. 5C1, 5C2 show the dental brush assembly 100 with the multi-orientation brush 324 in two separate orientations. The shank 500 has an offset configuration, and in FIG. 5C1, the multi-orientation brush 324 is shown in a first orientation with the brush surface 326 at angle J of approximately 120 degrees relative to the shank 500. In FIG. 5C2, the multi-orientation brush 324 is in a second orientation with the brush surface 326 at angle K of approximately 60 degrees relative to the shank 500 (some distortion of the angles is present due to the perspective view of the Figures). The angle J of the brush surface 326 in FIG. 5C1 allows the brush surface to easily access the facial mesial surfaces 509 (front tooth surfaces near the center of the mouth) of the anterior tooth 504. The angle J of the brush surface 326 in FIG. 5C2 allows the brush surface 326 to easily access the facial distal surfaces 511 (front tooth surface away from the center of the mouth) of the anterior tooth 504. Both orientations of the brush surface 326 allows the user to easily access both areas of the tooth 504 with a single tool with the handle 102 in substantially the same comfortable orientation. Additionally, the offset configuration allows the brush 324 to easily reach facial surfaces of the tooth 504 while the handle 102 extends outside of the mouth in a comfortable orientation for the user. Forming and finishing the facial distal and facial mesial surfaces of the anterior teeth are thereby easily performed to allow the user to form embrasures 513 between the teeth as desired.

Further, with the offset configuration shown in FIGS. 5C1, 5C2 (e.g., approximately 165 degrees as shown in FIGS. 2A, 2B), the dental brush assembly 100 can easily reach the posterior teeth (molars). The brush surface 326 is then usable to form and finish composite dental material along the facial and lingual sides of the posterior teeth as well as access anterior facing surfaces of the occlusal surfaces, such as cusps and ridges that face toward the mouth opening.

FIGS. 5D1 and 5D2 show the dental brush assembly 100 with the multi-orientation brush 324 in another orientation. In FIGS. 5D1, 5D2 the multi-orientation brush 324 is shown in a third orientation with the brush surface 326 at angle L of approximately 90 degrees relative to the shank 500 (some distortion of the angles is present due to the perspective view of the Figures). The angle L of the brush surface 326 in FIGS. 5D1, 5D2 allows the brush surface to easily access the facial surfaces 515 of the anterior tooth 504 (e.g., the surfaces between the distal and mesial areas of the tooth). The three orientations shown in FIGS. 5C1-5D2 provide full access to the entire facial surface of the anterior tooth 504. Further, the orientation shown in FIGS. 5D1, 5D2 further provides additional access to the anterior facing surfaces of the facial, lingual and occlusal surfaces of the molars while allowing the handle 102 of the dental brush assembly 100 to comfortably extend out of the mouth into the user's hand in a comfortable orientation.

Figure 6A:
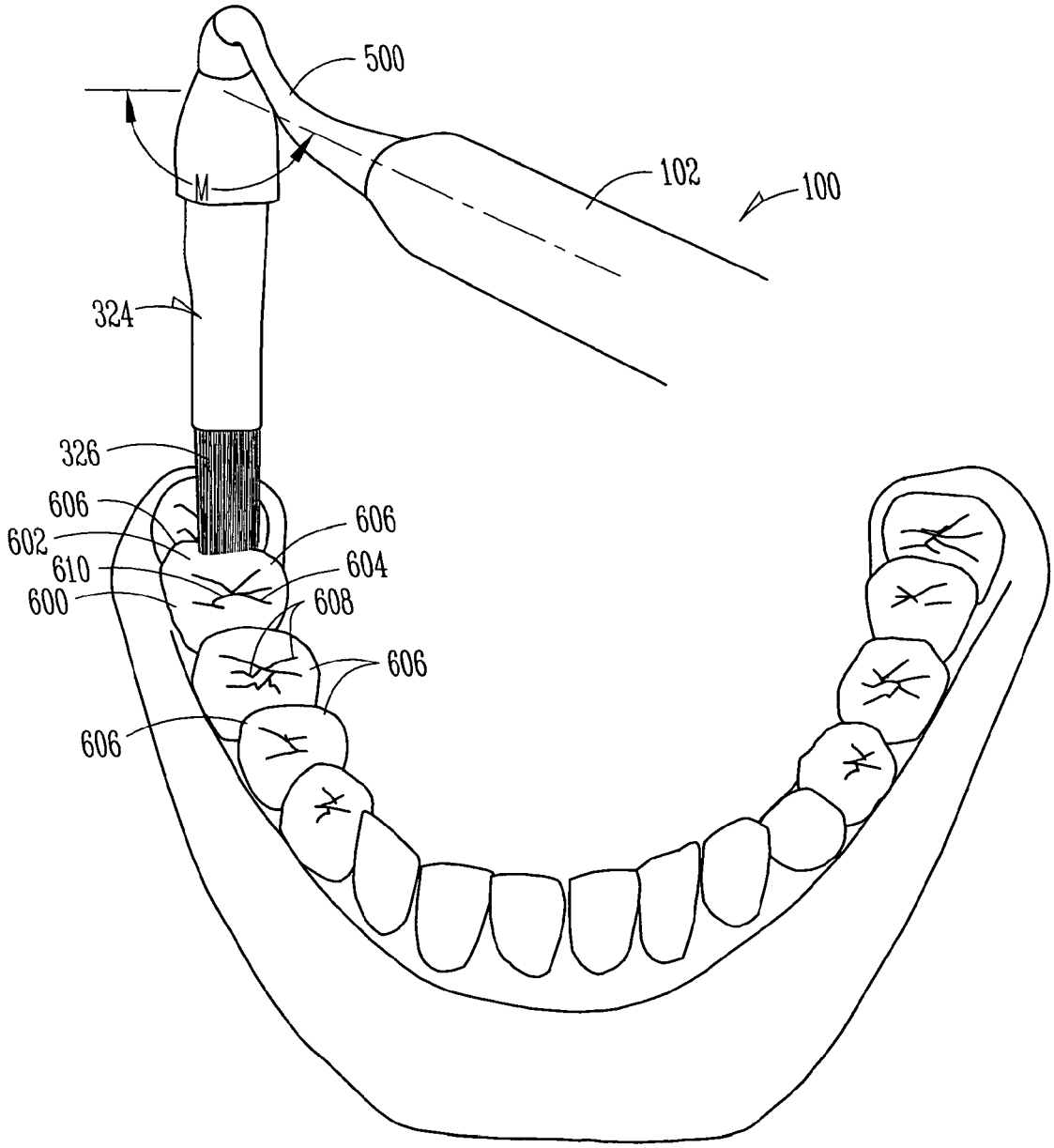
FIGS. 6A, 6B are views of exemplary posterior dental surfaces and elongate handle and brush orientations usable for dental work along the dental surfaces.
Figure 6B:
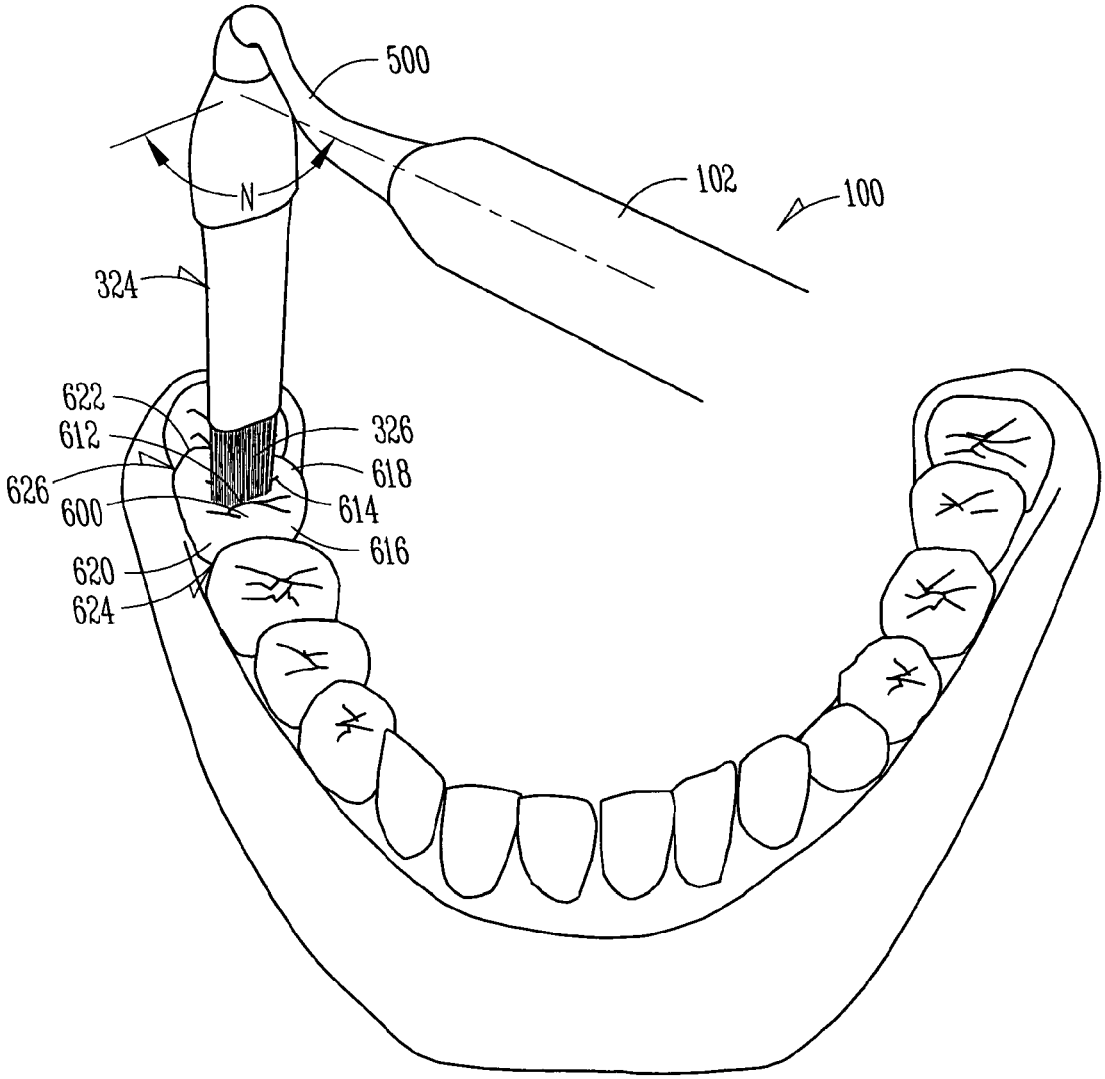

Referring now to FIGS. 6A, 6B, the dental brush assembly 100 is shown with the multi-orientation brush 324 in two separate orientations with the brush 324 adjacent a posterior tooth 600 (e.g., a molar). The shank 500 has a counter-offset configuration, and in FIG. 6A, the brush 324 is shown in a first orientation with the brush surface 326 at angle M of approximately 120 degrees relative to the elongate handle 102. In FIG. 6B, the brush 324 is in a second orientation with the brush surface 326 at angle N of approximately 60 degrees relative to the elongate handle 102 (The angles are distorted because of the perspective view of the Figures). The angle M of the brush surface 326 in FIG. 6A allows the brush surface to easily access the facial mesial surfaces 602 and lingual distal surfaces 604 of the occlusal portion of the tooth 600 (such as the ridges 608, cusps 606 (tips of the ridges) and fossa 610 (trough of the ridges) that form the chewing surfaces of the molars). The angle N of the brush surface 326 in FIG. 6B allows the brush surface to easily access the facial distal surfaces 612 and lingual mesial surfaces 614 of the occlusal portion of the tooth 600. Both orientations of the brush surface 326 allow the user to easily access all of the occlusal surfaces of the tooth 600 with a single tool with the handle 102 in substantially the same comfortable orientation. Additionally, where dental composite materials are formed behind features of the occlusal surfaces, the counter-offset configuration allows the brush 324 to easily reach behind these surfaces (cusps 606, ridges 608 and the like) and access the composite material for forming and finishing while the handle 102 extends outside of the mouth in a comfortable orientation for the user.

Further, in the orientations shown in FIGS. 6A, 6B, the brush surface 326 is also usable to access the lingual mesial 616, lingual distal 618, facial mesial 620 and facial distal 622 surfaces of the non-occlusal portions (e.g., the sides of the tooth) of the posterior tooth 600 as shown in FIG. 6B. With the orientations shown in 6A, 6B, the dental brush assembly 100 is thereby able to form and finish the composite materials along the posterior tooth 600 and thereby form the embrasures 624, 626 (lingual embrasures are concealed behind the tooth 600) between teeth as desired by the user.

Figure 7:
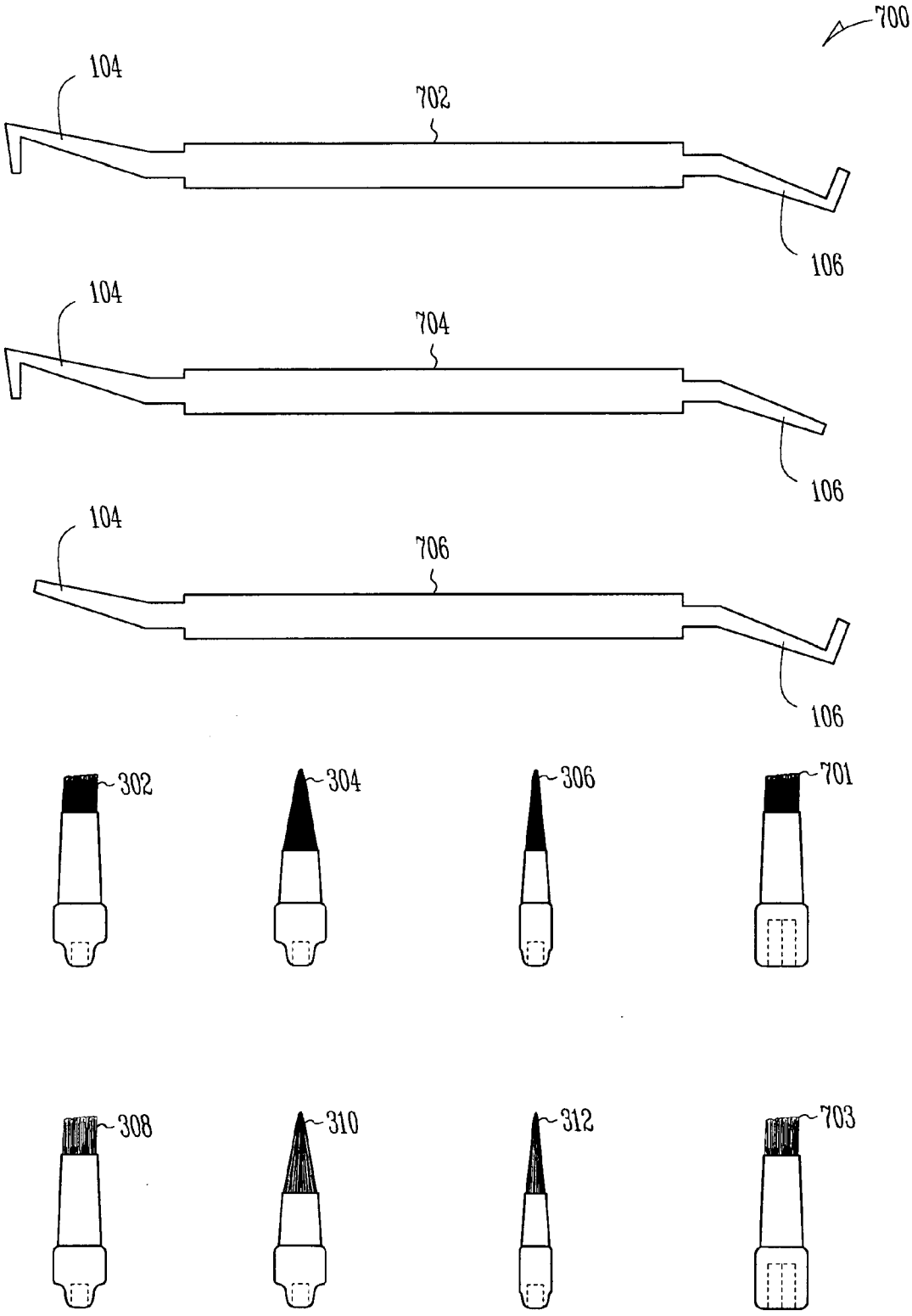
FIG. 7 is one example of a dental brush assembly kit including a variety of elongate handles and brushes usable with various dental surfaces.

As shown in FIG. 7, a kit 700 is provided including a selection of handles 702, 704, 706 and brushes 302, 304, 306, 308, 310, 312, 701, 703. The kit 700 in one example is provided in a sterile package and opened by the user prior to performing dental composite material formation and finishing with a patient. In another example, the kit 700 includes the handles 702, 704, 706 and the user may obtain a personal selection of brushes according to the desires of the user and needs of the patient. In still another example, the kit 700 is sterilized (further described below) and the handles 702, 704, 706 and brushes 302, 304, 306, 308, 310, 312, 701, 703 are replaced in a case for storage and easy access for future use. Optionally, the kit 700 includes a subset of brushes, for instance brushes 302, 304, 306, 308, 310, 312. Alternatively, the multi-orientation brushes 701, 703 may be included instead of brushes 302 and 308. The kit 700 includes soft brushes 308, 310, 312 and 703 for use with less viscous dental composite material. The kit 700 includes stiff brushes 302, 304, 306 and 701 for use with more viscous dental composite material that is difficult to form and finish with softer bristles.

The kit 700 includes the handles 702, 704, 706 which substantially correspond to the examples of handles shown in FIGS. 2A-C. As previously described, each handle 702, 704, 706 provides varying access to different dental surfaces relative to the other handles and thereby provides an advantageous instrument to form and finish composite materials. Each handle 702, 704, 706 provides a combination of shanks 104, 106 (FIGS. 2A-C) that correspondingly combine a selection of brush orientations that are desirable for particular dental surfaces, such as, the posterior teeth (molars), for example. The user may thereby need a subset of the handles 702, 704, 706 and brushes 302, 304, 306, 308, 310, 312, 701, 703 to adequately finish a composite dental surface for a particular tooth.

Figure 8:
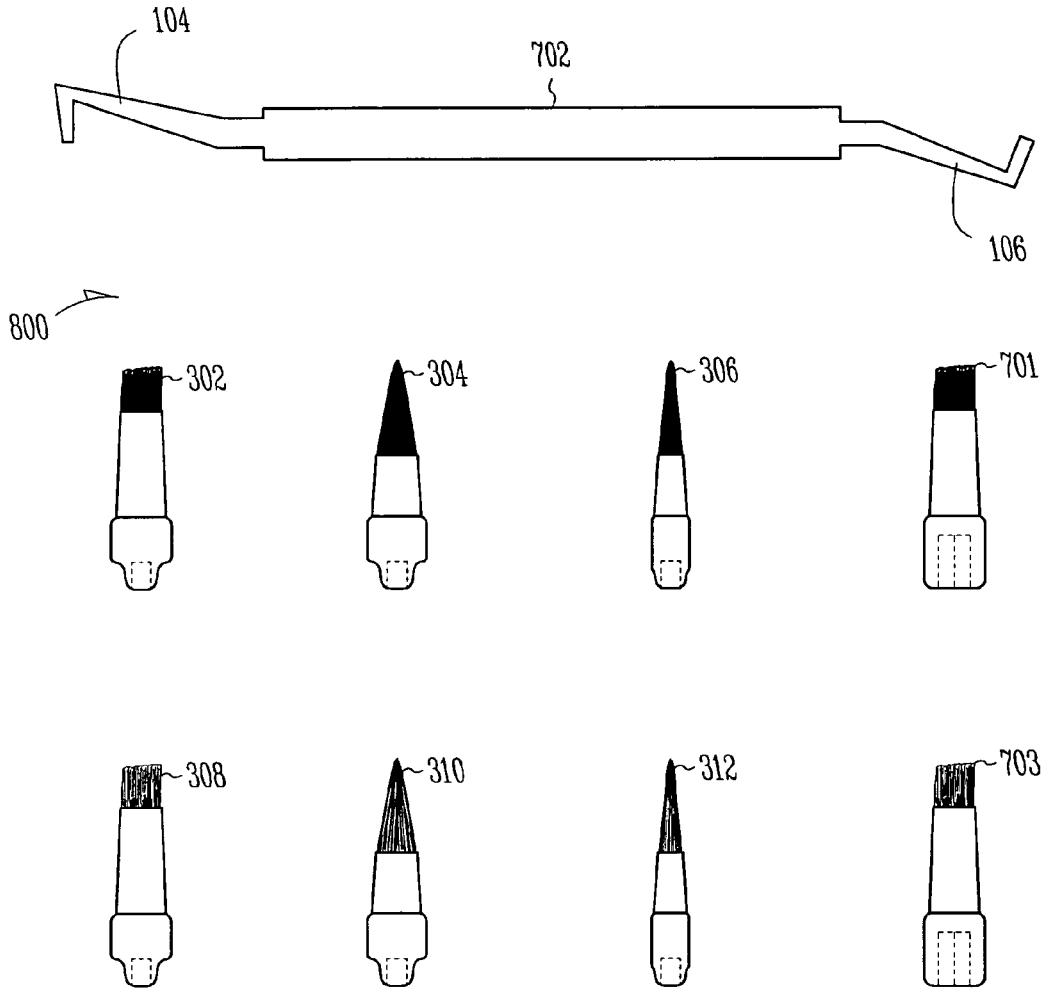
FIG. 8 is another example of a dental brush assembly kit including elongate handles and brushes usable with a particular dental surface.

As shown in FIG. 8, kit 800 includes one example of a handle 702 with shanks 104, 106 sized and shaped for use with the posterior teeth. The kit 800 further includes a set of brushes 302, 304, 306, 308, 310, 312, 701, 703 as described above. Optionally, the user may obtain a subset of these brushes to fit the particular needs of the procedure or the technique of the user. As described above, handle 702 with its counter-offset shanks 104, 106 (see FIGS. 2A-2C) may be used advantageously on the posterior teeth, such as the molars. The kit 800 thereby provides a dental brush assembly that is assembled for a particular dental surface, as shown in FIG. 8 for the posterior teeth. In another example, the other handles 704, 706 or a subset of handles 702, 704, 706 are assembled into a kit with the desired brushes for any variety of dental features, including, but not limited to, anterior teeth, facial surfaces, lingual surfaces, occlusal surfaces (chewing surfaces), gingival surfaces and the like.

Figure 9:
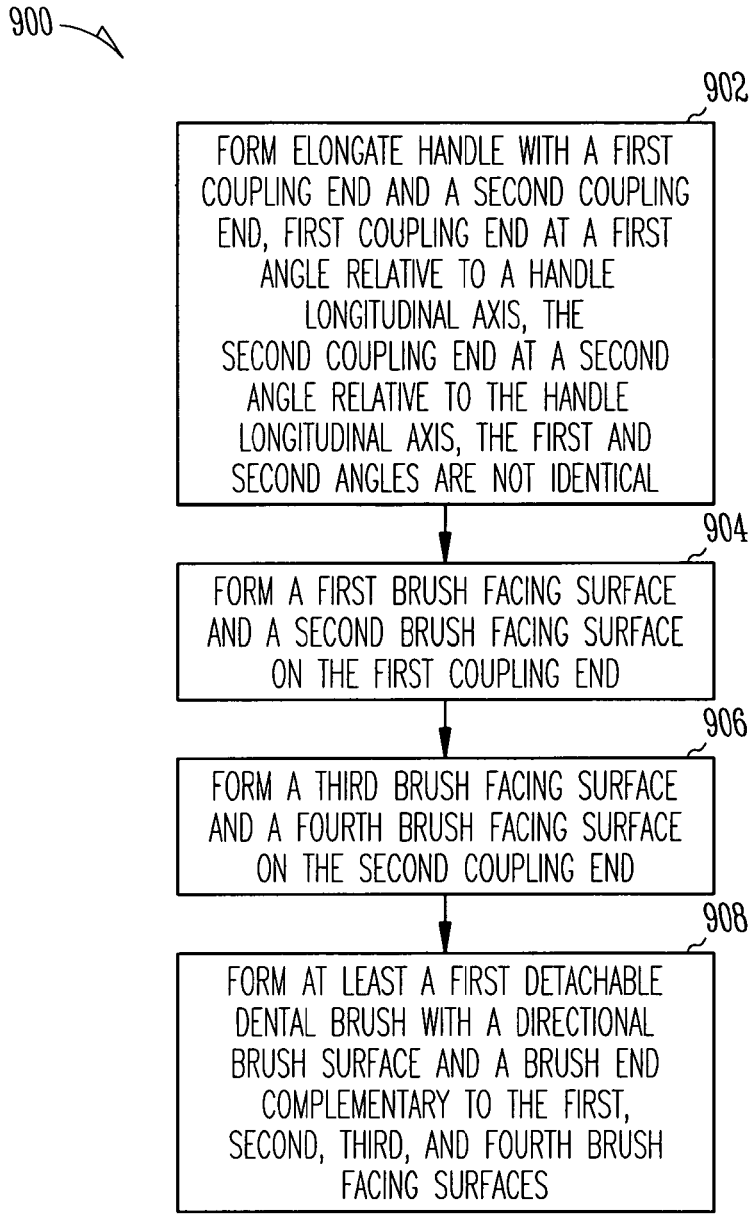
FIG. 9 is a block diagram showing one example of a method for making a dental brush assembly.

FIG. 9 is a block diagram illustrating a method 900 for making a dental brush assembly, such as dental brush assembly 100 described above and shown in FIGS. 1-7. At 902, an elongate handle 102 is formed with a first coupling end (e.g., first coupling 110 and first shank 104) and a second coupling end (e.g., second coupling 114 and second shank 106). See FIG. 1. The first coupling end is at a first angle relative to a handle longitudinal axis 200 (FIG. 2), and the second coupling end is at a second angle relative to the handle longitudinal axis 200; the first and second angles are not identical. For instance, as shown in FIGS. 2A-C, the shanks 104, 106 have different angles and offsets relative to each other to provide a variety of brush orientations. In one example, the elongate handle 102 is formed with a handle diameter 109 greater than coupling end diameters 105, 107 of the first and second coupling ends (e.g., diameters of the couplings 110, 114 and the shanks 104, 106).

At 904, a first brush facing surface and a second brush facing surface are formed on the first coupling end (e.g., the first coupling 110). In one example, brush facing surfaces include surfaces 404, 406, 408 formed on the coupling end as shown in FIG. 4. At 906, third and fourth brush facing surfaces are formed on the second coupling end (e.g., the second coupling 114). As previously described, because each of the shanks 104, 106 has a different geometry, the brush facing surfaces of the second coupling 114, identical in one example to surfaces 404, 406, 408, provide different brush orientations. At 908, the method 900 includes forming at least a first detachable multi-orientation brush 324 (FIGS. 3G, 3G1, 3G2) with a directional brush surface 326 and a brush end 312 complementary to the first, second, third and fourth brush facing surfaces for first and second coupling ends.

When the multi-orientation brush 324 is coupled with the first coupling end (e.g., first coupling 110) and oriented with the first brush facing surface (e.g., one of surfaces 404, 406, 408) the directional brush surface 326 is directed in a first orientation relative to the handle longitudinal axis 200, and when the first detachable dental brush 324 is oriented with the second brush facing surface (e.g., another of the surfaces 404, 406, 408) the directional brush surface 326 is directed in a second orientation relative to the handle longitudinal axis 200. Similarly, when the first detachable dental brush 324 is coupled with the second coupling end (e.g., second coupling 114) and oriented with the third brush facing surface (one of the surfaces 404, 406, 408 on the second coupling 114) the directional brush surface 326 is directed in a third orientation relative to the handle longitudinal axis 200, and when the first detachable dental brush 324 is oriented with the fourth brush facing surface (another of the surfaces 404, 406, 408 on the second coupling 114) the directional brush surface 326 is directed in a fourth orientation relative to the handle longitudinal axis 200. The first, second, third and fourth orientations are not identical.

Several options for the method 900 are provided below. In one example, forming the first brush facing surface (e.g., one of surfaces 404, 406, 408 shown in FIG. 4) and a second brush facing surface (another of the surfaces 404, 406, 408) on the first coupling end includes forming a fifth brush facing surface on the first coupling end (another of the surfaces 404, 406, 408). The first, second and fifth brush facing surfaces are not parallel with each other. For instance they form the triangular pattern of the coupling 400 shown in FIG. 4. When the first detachable dental brush 324 is coupled with the first coupling end 110 and oriented with the fifth brush facing surface the directional brush surface 326 is directed in a fifth orientation relative to the handle longitudinal axis 200 (FIG. 2), and the fifth orientation is not identical with the first, second, third and fourth orientations.

In another example, forming at least the first detachable dental brush 324 with the directional brush surface 326 and the brush end 312 complementary to the first, second, third and fourth brush facing surfaces, includes forming a brush end 312 configured to non-rotatably couple with the first and second coupling ends (e.g., couplings 110, 114). As described above, the brush end 312 and couplings 110, 114 include, but are not limited to, complementary non-circular, ovular, triangular, star, square, pin/multiple orifice geometries and the like. Optionally, forming the elongate handle 102 (FIG. 1) includes forming non-circular first and second couplings 110, 114 configured to non-rotatably couple with at least the first detachable dental brush 324.

In still another example, the method 900 includes forming a brush end 312 of the detachable dental brush (e.g., brushes 302, 304, 306, 308, 310, 312, 324) configured to detachably lock with the first coupling 110 and the second coupling end 114. For example, forming the elongate handle 102 with the first coupling 110 and the second coupling 114 includes forming at least one groove 410 (FIG. 4) in one of the first and second couplings 110, 114, and the first detachable dental brush 302, 304, 306, 308, 310, 312, 324 with the brush end 312 is formed with a detent 412 sized and shaped to fit in the at least one groove 410. Optionally, the at least one groove 410 is disposed on the brush end 312 and the detent 412 is formed on the coupling 110, 114. Other means for removably locking the brush 300, 302, 304, 306, 308, 310, 324 with the coupling include, but are not limited to, magnetic features, temporary adhesives, snap-fit features, friction engagement and the like, as previously described above.

In yet another example, the method 900 further includes forming a second detachable dental brush 304, 310 (FIG. 3) with a pointed geometry, the second detachable dental brush 304, 310 having a brush end 312 configured to couple with the first and second couplings 110, 114. In another example, forming the first detachable dental brush includes forming a first soft detachable dental brush 306, 308, 322 (and soft brush 324) and a first stiff detachable dental brush 300, 302, 304 (and stiff brush 324).

Figure 10:
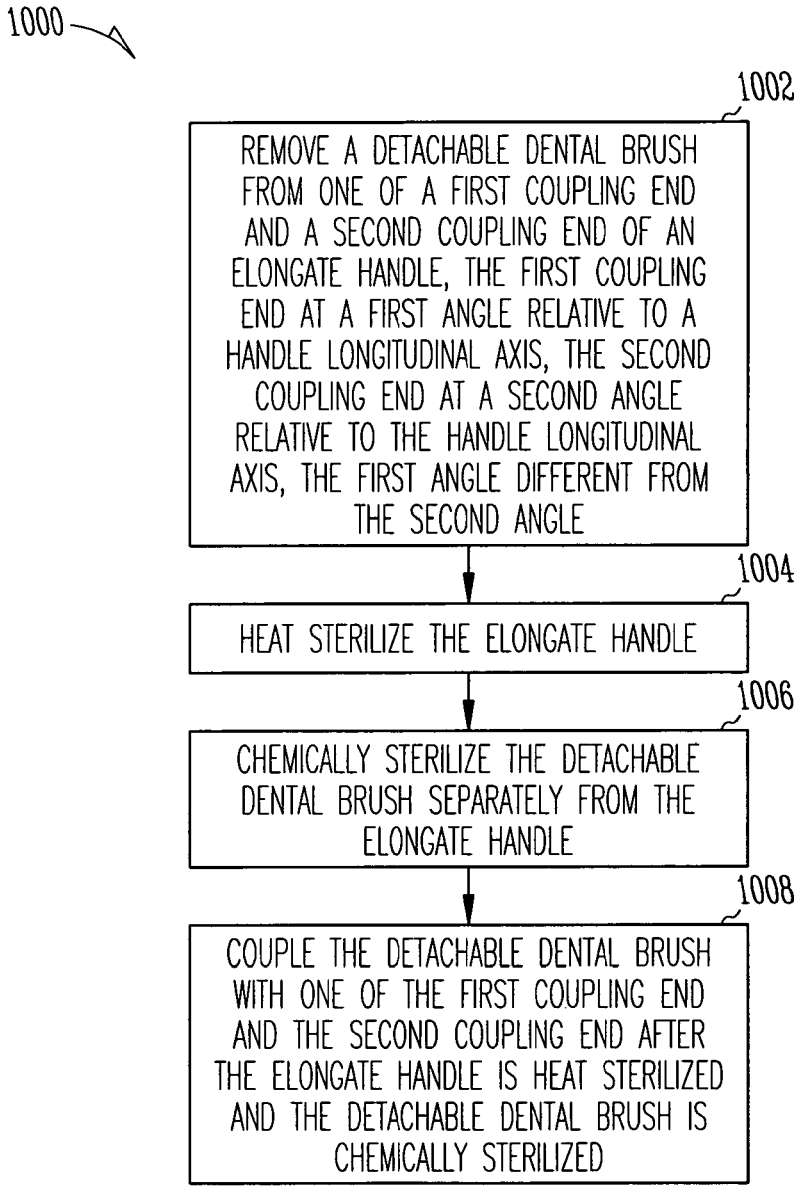
FIG. 10 is a block diagram showing one example of a method for sterilizing a dental brush assembly of the type described herein.

In FIG. 10, one example of a method 1000 for sterilizing a dental brush assembly, such as dental brush assembly 100 shown in FIGS. 1-8, is shown. At 1002, a detachable dental brush 300, 302, 304, 306, 308, 310, 324 is removed from one of a first coupling end (coupling 110 and shank 104) and a second coupling end (coupling 114 and shank 106) of an elongate handle 102. The first coupling end (coupling 110 and shank 104) is at a first angle (e.g., A, C, E as shown in FIGS. 2A-C) relative to a handle longitudinal axis 200, and the second coupling end (coupling 114 and shank 106) is at a second angle (e.g., B, D, F as shown in FIGS. 2A-C) relative to the handle longitudinal axis 200. The first angle is non-identical to the second angle.

At 1004, the elongate handle 102 is separated from the detachable dental brush, and the handle 102 is heat sterilized. The heat sterilization process provides a rapid and effective manner to eliminate contaminants, microorganisms and the like. Because the elongate handle 102 is constructed with materials such as aluminum, stainless steel and plastics, the handle 102 can withstand the heat of the sterilization process, and is thereafter ready for future use with the detachable dental brushes. At 1006, the detachable dental brush 300, 302, 304, 306, 308, 310, 324 (FIG. 3) is chemically sterilized separately from the elongate handle 102. For instance, the brushes 300, 302, 304, 306, 308, 310, 324 are sterilized with rubbing alcohol, quaternary ammonium products and the like to similarly eliminate contaminants and microorganisms. The chemical sterilization is less harsh on the brushes 300, 302, 304, 306, 308, 310, 324 than heat sterilization and does not substantially damage the brush surfaces 318, 320, 322, 326. The chemical sterilization thereby allows for repeated sterile use of the brushes. At 1008, the detachable dental brush 300, 302, 304, 306, 308, 310, 324 is coupled with one of the first coupling and second couplings 110, 114 after the elongate handle 102 is heat sterilized and the detachable dental brush is chemically sterilized. Optionally, the used detachable dental brush 300, 302, 304, 306, 308, 310, 324 is discarded in favor of a sterile replacement brush thereby eliminating the need to chemically sterilize the used brush.

The above described dental brush assembly provides a comfortable handle having multiple non-identical orientations for brushes on the ends of the handle. The orientations are created using a variety of coupling end angles, offsets of the coupling ends and orienting the brushes with the brush facing surfaces of the coupling ends. The multiple orientations provide varied angles of attack on a variety of tooth surfaces throughout the mouth to facilitate the forming and finishing of dental composite material on the tooth surfaces. The multiple orientations allow for ease of use in compact and difficult-to-reach areas of the mouth while allowing the user to perform detailed work on the dental composite to form it relative to the surrounding tooth surfaces (e.g., finishing the composite material into a smooth surface that is flush with the tooth surface). Moreover, the non-linear orientations of the brush relative to the handle improve visibility of the operative field (e.g., the dental surface) for the user where a straight brush and handle combination may partially conceal the dental surface. Further, the user is able to comfortably manipulate the dental brush assembly into the various orientations within the mouth while maintaining the elongate handle in a relatively comfortable posture for the hand of the user.

Additionally, the user is able to choose a particular handle having the desired coupling end orientations (angles and offsets) along with the desired brushes according to the user's particular technique. The user is thereby able to assemble a dental brush assembly that is comfortable and is configured to optimally form and finish dental composite material according to the technique of the user. Moreover, the user is able to choose a particular handle and brush combination or combinations to provide the best access and brush orientations for a particular tooth surface, such as a the posterior teeth (e.g., molars). As described above, kits are provided for the user to assemble the dental brush assembly according to the needs and/or technique of the user.

Further still, the detachable dental brushes allow for easy sterilization of the handle by heat sterilization. The handle is thereby rapidly and effectively sterilized prior to the next procedure. The detached brushes are chemically sterilized separately to preserve the integrity of the brushes. The sterilized brush assembly is then assembled prior to the procedure. Alternatively, the used brushes are detached from the handle and discarded in favor of replacement sterile brushes.

It is to be understood that the above description is intended to be illustrative and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A dental brush assembly comprising:

an elongate handle;

a first coupling end of the elongate handle sized and shaped to couple with at least a first detachable dental brush, the first coupling end at a first angle relative to a handle longitudinal axis;

a second coupling end of the elongate handle sized and shaped to couple with at least the first detachable dental brush, the second coupling end at a second angle relative to the handle longitudinal axis, the second angle differing from the first angle;

wherein the first coupling end includes a first brush facing surface and a second brush facing surface, and the second coupling end includes a third brush facing surface and a fourth brush facing surface;

the first detachable dental brush includes a directional brush surface and a brush end complementary to the first, second, third and fourth brush facing surfaces;

wherein when the first detachable dental brush is coupled with the first coupling end and oriented with the first brush facing surface, the directional brush surface is directed in a first orientation relative to the handle longitudinal axis, and when the first detachable dental brush is oriented with the second brush facing surface, the directional brush surface is directed in a second orientation relative to the handle longitudinal axis; and wherein when the first detachable dental brush is coupled with the second coupling end and oriented with the third brush facing surface, the directional brush surface is directed in a third orientation relative to the handle longitudinal axis, and when the first detachable dental brush is oriented with the fourth brush facing surface the directional brush surface is directed in a fourth orientation relative to the handle longitudinal axis, and the first, second, third and fourth orientations are not identical.

2. The dental brush assembly of claim 1, wherein the first coupling end includes a fifth brush facing surface, and when the first detachable dental brush is coupled with the first coupling end and oriented with the fifth brush facing surface, the directional brush surface is directed in a fifth orientation relative to the handle longitudinal axis, the fifth orientation not identical with the first, second, third and fourth orientations.

3. The dental brush assembly of claim 2, wherein the second coupling end includes a sixth brush facing surface, and when the first detachable dental brush is coupled with the second coupling end and oriented with the sixth brush facing surface, the directional brush surface is directed in a sixth orientation relative to the handle longitudinal axis, the sixth orientation not identical with the first, second, third, fourth and fifth orientations.

4. The dental brush assembly of claim 1, wherein the first detachable dental brush has a non-circular brush end sized and shaped to couple with a non-circular coupling end of at least one of the first and second coupling ends, the non-circular brush end and the non-circular coupling end preventing rotation therebetween.

5. The dental brush assembly of claim 4, wherein a perimeter of the non-circular brush end includes the first brush facing surface and the second brush facing surface, and the first brush facing surface is not parallel with the second brush facing surface.

6. The dental brush assembly of claim 1, wherein the brush end is sized and shaped to detachably lock with at least one of the first and second coupling ends.

7. The dental brush assembly of claim 6, wherein one of the brush end and the first and second coupling ends includes a groove, and the other of the brush end and the first and second coupling ends includes a detent sized and shaped to fit in the groove.

8. The dental brush assembly of claim 1 further comprising a second detachable dental brush coupled with one of the first or second coupling ends, while the first detachable dental brush is coupled with the other of the first or second coupling ends.

9. The dental brush assembly of claim 8, wherein the second detachable dental brush has a configuration consisting of one of a directional brush configuration, pointed configuration or a flat configuration.

10. The dental brush assembly of claim 1, wherein the elongate handle has a handle diameter greater than a coupling end diameter of the first and second coupling ends.

11. The dental brush assembly of claim 1, wherein at least one of the first and second coupling ends includes a counter-offset configuration sized and shaped to position the first detachable dental brush near the handle longitudinal axis.

12. The dental brush assembly of claim 1, wherein at least one of the first and second coupling ends includes an offset configuration sized and shaped to position the first detachable dental brush remote from the handle longitudinal axis.

13. A method for making a dental brush assembly comprising:

forming an elongate handle with a first coupling end and a second coupling end, the first coupling end at a first angle relative to a handle longitudinal axis, the second coupling end at a second angle relative to the handle longitudinal axis, wherein the first and second angles are not identical forming a first brush facing surface and a second brush facing surface on the first coupling end;

forming a third brush facing surface and a fourth brush facing surface on the second coupling end;

forming at least a first detachable dental brush with a directional brush surface and a brush end complementary to the first, second, third and fourth brush facing surfaces;

wherein when the first detachable dental brush is coupled with the first coupling end and oriented with the first brush facing surface the directional brush surface is directed in a first orientation relative to the handle longitudinal axis, and when the first detachable dental brush is oriented with the second brush facing surface the directional brush surface is directed in a second orientation relative to the handle longitudinal axis; and wherein when the first detachable dental brush is coupled with the second coupling end and oriented with the third brush facing surface the directional brush surface is directed in a third orientation relative to the handle longitudinal axis, and when the first detachable dental brush is oriented with the fourth brush facing surface the directional brush surface is directed in a fourth orientation relative to the handle longitudinal axis, and the first, second, third and fourth orientations are not identical.

14. The method of making the dental brush assembly of claim 13, wherein forming the first brush facing surface and the second brush facing surface on the first coupling end includes forming a fifth brush facing surface on the first coupling end, the first, second and fifth brush facing surfaces not parallel with each other, and when the first detachable dental brush is coupled with the first coupling end and oriented with the fifth brush facing surface the directional brush surface is directed in a fifth orientation relative to the handle longitudinal axis, the fifth orientation not identical with the first, second, third and fourth orientations.

15. The method of making the dental brush assembly of claim 13, wherein forming at least the first detachable dental brush with the directional brush surface and the brush end complementary to the first, second, third and fourth brush facing surfaces includes forming a brush end configured to non-rotatably couple with the first and second coupling ends.

16. The method of making the dental brush assembly of claim 13, wherein forming the elongate handle with the first coupling end and the second coupling end includes forming non-circular first and second coupling ends configured to non-rotatably couple with at least the first detachable dental brush.

17. The method of making the dental brush assembly of claim 13, wherein forming at least the first detachable dental brush with the brush end configured to couple with the first and second coupling ends includes forming a brush end configured to detachably lock with the first coupling end and the second coupling end.

18. The method of making the dental brush assembly of claim 13, wherein forming the elongate handle with the first coupling end and the second coupling end includes forming at least one groove in one of the first coupling end and the second coupling end; and forming at least the first detachable dental brush with the brush end configured to couple with the first and second coupling ends includes forming the brush end with a detent sized and shaped to fit in the at least one groove.

19. The method of making the dental brush assembly of claim 13 further comprising forming a second detachable dental brush with a pointed geometry, the second detachable dental brush having a brush end configured to couple with the first and second coupling ends.

20. The method of making the dental brush assembly of claim 13, wherein forming the first detachable dental brush includes forming a first soft detachable dental brush and a first stiff detachable dental brush.

21. The method of making the dental brush assembly of claim 13, wherein forming the elongate handle includes forming the elongate handle with a handle diameter greater than a coupling end diameter of the first and second coupling ends.

22. A dental brush assembly comprising:

an elongate handle having a handle longitudinal axis;

a first coupling end of the elongate handle sized and shaped to couple with at least a first detachable dental brush, the first coupling end having a first shape;

the first detachable dental brush directed outside of the handle longitudinal axis according to the first shape;

a second coupling end of the elongate handle sized and shaped to couple with at least the first detachable dental brush, the second coupling end having a second shape different from the first shape; and the first detachable dental brush directed outside of the elongate handle longitudinal axis according to the second shape.

23. The dental brush assembly of claim 22, wherein at least one of the first shape and the second shape includes a counter-offset configuration sized and shaped to position the first detachable dental brush near the handle longitudinal axis.

24. The dental brush assembly of claim 22, wherein at least one of the first shape and the second shape includes an offset configuration sized and shaped to position the first detachable dental brush remote from the handle longitudinal axis.

25. The dental brush assembly of claim 22, wherein the first coupling end includes a first brush facing surface and a second brush facing surface, and when the first detachable dental brush is coupled with the first coupling end and oriented with the first brush facing surface a directional brushing surface of the first detachable dental brush provides a first angle of attack toward a specified dental surface, and when oriented with the second brush facing surface the directional brushing surface provides a second angle of attack toward the specified dental surface, wherein the first angle of attack is unique from the second angle of attack, and the first and second angles of attack are measured from the handle longitudinal axis.

26. The dental brush assembly of claim 25, wherein the second coupling end includes a third brush facing surface and a fourth brush facing surface, and when the first detachable dental brush is coupled with the second coupling end and oriented with the third brush facing surface, the directional brushing surface provides a third angle of attack toward the specified dental surface, and when oriented with the fourth brush facing surface, the directional brushing surface provides a fourth angle of attack toward the specified dental surface, wherein each of the first, second, third and fourth angles of attack are unique, and the third and fourth angles of attack are measured from the handle longitudinal axis.

27. The dental brush assembly of claim 22, wherein the first detachable dental brush has a non-circular brush end sized and shaped to couple with a non-circular coupling end of at least one of the first and second coupling ends, the non-circular brush end and the non-circular coupling end preventing rotation therebetween.

28. The dental brush assembly of claim 22, wherein the first detachable dental brush has a brush end sized and shaped to detachably lock with at least one of the first and second coupling ends.

29. The dental brush assembly of claim 28, wherein one of the brush end and the first and second coupling ends includes a groove, and the other of the brush end and the first and second coupling ends includes a detent sized and shaped to fit in the groove.

30. The dental brush assembly of claim 22 further comprising a second detachable dental brush coupled with one of the first or second coupling ends, while the first detachable dental brush is coupled with the other of the first or second coupling ends.

31. The dental brush assembly of claim 30, wherein the second detachable dental brush has a configuration consisting of one of a directional brush configuration, pointed configuration or a flat configuration.

32. The dental brush assembly of claim 31, wherein the elongate handle has a handle diameter greater than a coupling end diameter of the first and second coupling ends.

* * * * *

UNITED STATES PATENT AND TRADEMARK OFFICE

CERTIFICATE OF CORRECTION

PATENT NO. : 8,621,701 B2
APPLICATION NO. : 12/918645
DATED : January 7, 2014
INVENTOR(S) : Michael R. Meharry It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 674 days.

Signed and Sealed this
Twenty-second Day of September, 2015

Michelle K. Lee

Michelle K. Lee
*Director of the United States Patent and Trademark Office*